US011166496B2

(12) United States Patent
Lynch

(10) Patent No.: US 11,166,496 B2
(45) Date of Patent: Nov. 9, 2021

(54) LOOMS FOR INCLUSION WITHIN ITEMS OF CLOTHING

(71) Applicant: Wearable Technology Limited, Leicester (GB)

(72) Inventor: Michael John Lynch, Leicester (GB)

(73) Assignee: Wearable Technology Limited, Leicester (GB)

( * ) Notice: Subject to any disclaimer, the term of this patent is extended or adjusted under 35 U.S.C. 154(b) by 86 days.

(21) Appl. No.: 16/585,595

(22) Filed: Sep. 27, 2019

(65) Prior Publication Data

US 2020/0022428 A1 Jan. 23, 2020

Related U.S. Application Data

(63) Continuation-in-part of application No. PCT/GB2018/000056, filed on Apr. 4, 2018.

(30) Foreign Application Priority Data

Apr. 4, 2017 (GB) ..... 1705376

(51) Int. Cl.
*H05B 45/20* (2020.01)
*A41D 1/00* (2018.01)
(Continued)

(52) U.S. Cl.
CPC ..... *A41D 1/005* (2013.01); *A41D 13/01* (2013.01); *H05B 45/20* (2020.01); *H05B 47/18* (2020.01)

(58) Field of Classification Search
CPC ..... F21V 23/0471; F21V 23/001; F21V 33/0008; F21V 23/0407; F21V 23/0492;
(Continued)

(56) References Cited

U.S. PATENT DOCUMENTS 7,144,830 B2 * 12/2006 Hill ..... H05K 1/038 442/205
9,858,794 B2 * 1/2018 McCleary ..... G08B 21/0446
(Continued)

FOREIGN PATENT DOCUMENTS

CA 2379247 A1 2/2003
DE 202005021140 U1 8/2007
(Continued)

OTHER PUBLICATIONS

Corresponding International Application Patent No. PCT/GB2018/000056, International Search Report and Written Opinion, dated Jun. 28, 2018.

*Primary Examiner* — Haissa Philogene
(74) *Attorney, Agent, or Firm* — Cooper Legal Group, LLC

(57) ABSTRACT

Light emitting devices attached to an item of clothing are illuminated. The light emitting devices are attached to a loom that is terminated by an interface circuit that includes a data storage device (102). Configuration data (1703) is written to the data storage device and the loom is located within an item of clothing. A control unit (1502) is connected to the interface circuit and is configured to supply power and control data to the light emitting devices. Configuration data (1805) from the data storage device is transferred to the control unit, such that the control unit supplies control data to light emitting devices in a form determined by this configuration data.

12 Claims, 24 Drawing Sheets

(51) Int. Cl.
*H05B 47/18* (2020.01)
*A41D 13/01* (2006.01)

(58) Field of Classification Search
CPC ..... F21V 23/06; A41D 1/002; A41D 1/005; A41D 1/04; A41D 1/02; A41D 19/0024; A41D 13/01; A41D 27/085; H05B 45/10; H05B 45/20; H05B 47/18; F21Y 2115/10; F21Y 2113/10; G08B 5/004; G08B 21/0446
See application file for complete search history.

(56) References Cited

U.S. PATENT DOCUMENTS

| | | | | |
|---|---|---|---|---|
| 10,161,611 | B2 * | 12/2018 | Bernstein | F21V 23/0471 |
| 10,180,244 | B2 * | 1/2019 | Stamatatos | F21V 23/0435 |
| 10,539,312 | B2 * | 1/2020 | Bernstein | F21V 23/0407 |
| 10,653,192 | B2 * | 5/2020 | Chen | A41D 27/085 |
| 10,891,837 | B2 * | 1/2021 | Robinson | A41D 13/01 |
| 2014/0355257 | A1 | 12/2014 | Anteby | |
| 2016/0180680 | A1 | 6/2016 | Bernstein | |
| 2017/0248272 | A1 | 8/2017 | Ullrich et al. | |

FOREIGN PATENT DOCUMENTS

| | | | |
|---|---|---|---|
| DE | 102015206608 | A1 | 4/2016 |
| GB | 2459944 | A | 11/2009 |
| GB | 2521652 | A | 7/2015 |

* cited by examiner

LOOMS FOR INCLUSION WITHIN ITEMS OF CLOTHING

CROSS REFERENCE TO RELATED APPLICATIONS

This application is a continuation-in-part of and claims priority from international patent application PCT/GB2018/000056 filed Apr. 4, 2018, which claims priority from GB 1705376.0 filed Apr. 4, 2017. The whole contents of international patent application PCT/GB2018/000056 and GB 1705376.0 are incorporated herein by way of reference.

BACKGROUND OF THE INVENTION

The present invention relates to an apparatus for inclusion within an item of clothing, of the type in which said item of clothing is configured to enhance visibility and support electrical equipment, comprising a plurality of addressable light emitting devices and a loom for supplying power and control-data from a control unit to the light emitting devices.

The present invention also relates to a method of illuminating light emitting devices attached to an item of clothing, of the type including the step of attaching a plurality of light emitting devices to a loom.

It is known to include electrical conductors within items of clothing, as disclosed in GB 2,521,652 assigned to the present applicant. To maintain the integrity of the electrical conductors, the conductors are retained within seams during the garment manufacturing process.

The inclusion of conductors within seams significantly enhances the durability of the garment, and, in particular, facilitates commercial machine washing. However, it has been realised that, by incorporating electrical conductors and devices as part of a manufacturing process, the process itself becomes substantially more sophisticated compared to processes required for the manufacture of conventional garments. This can increase the cost of manufacture significantly and also increases the risk of manufacturing errors occurring, that may result in a malfunction during operation. It has been appreciated that when working in hazardous conditions, malfunctions of this type cannot be tolerated.

BRIEF SUMMARY OF THE INVENTION

According to a first aspect of the present invention, there is provided an apparatus for inclusion within an item of clothing, wherein said item of clothing is configured to enhance visibility and support electrical equipment, comprising: a plurality of addressable light emitting devices; and a loom for supplying power and control data from a control unit to said light emitting devices; an interface circuit connected to said loom and including a connector for releasably connecting to a control unit, wherein: said interface circuit includes a data storage device configured to receive configuration data; said interface circuit supplies said configuration data to a connected control unit; and said control unit supplies control data to said light emitting devices in accordance with said configuration data.

DETAILED DESCRIPTION OF EXAMPLE EMBODIMENTS

Embodiments of the invention will be described, by way of example only, with reference to the accompanying drawings. The detailed embodiments show the best mode known to the inventor and provide support for the invention as claimed. However, they are only exemplary and should not be used to interpret or limit the scope of the claims. Their purpose is to provide a teaching to those skilled in the art.

Components and processes distinguished by ordinal phrases such as "first" and "second" do not necessarily define an order or ranking of any sort.

FIG. 1

Figure 1:
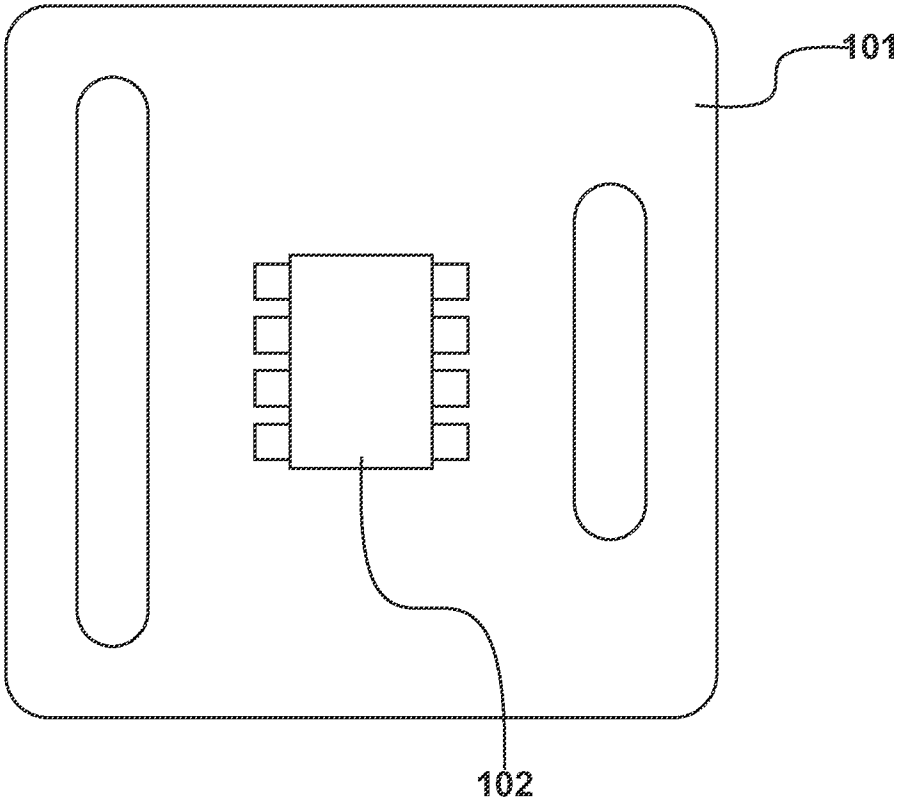
FIG. 1 shows a circuit board used in the construction of an interface circuit.
Figure 2:
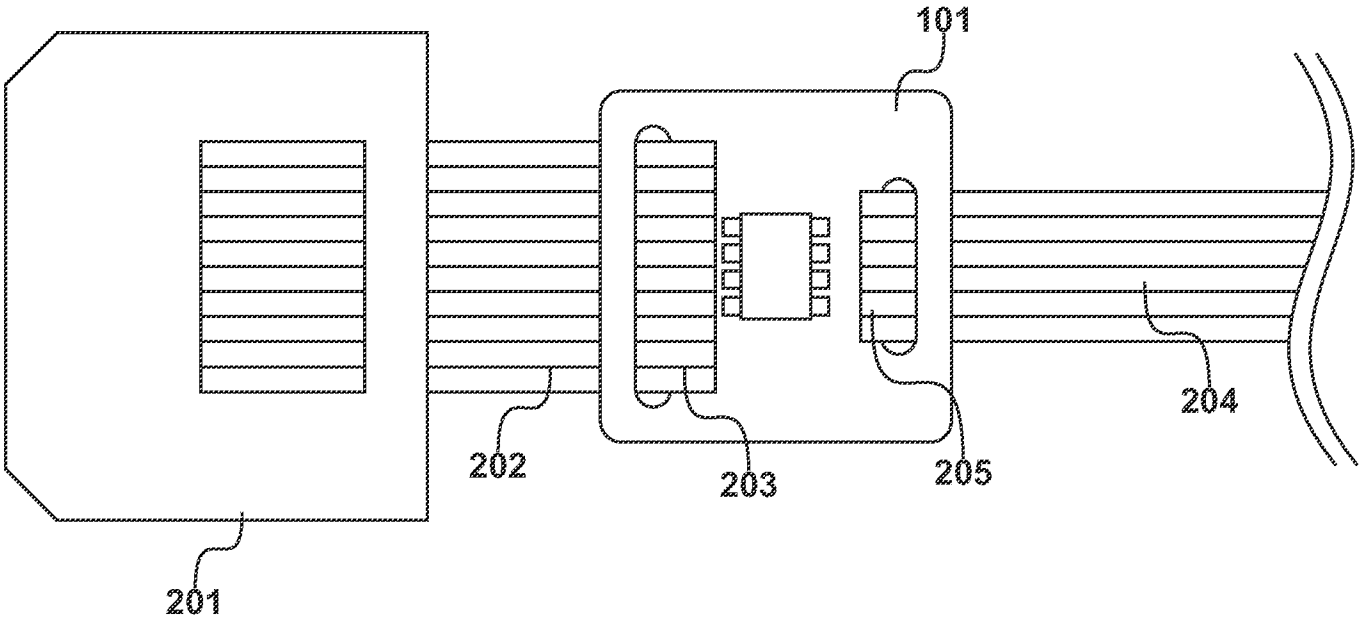
FIG. 2 shows the connection of wires to the circuit board identified in FIG. 1.

A circuit board 101 is shown in FIG. 1, that provides a starting point for the construction of an interface circuit. The interface circuit includes a data storage device 102 configured to receive configuration data. The interface circuit is then arranged to supply this configuration data to a connected control unit, such that the control unit supplies control data to the light emitting devices in accordance with the configuration data. Initially, the device may be supplied with default configuration data, that ensures that the control unit is in a position to cause the connected light emitting devices to flash or to maintain a constant illuminated state. However, more sophisticated configurations are possible by defining specific configuration data for the activity required. This configuration data is then loaded to the control unit by being read from the data storage device 102.

In an embodiment, the data storage device 102 is implemented as an electrically erasable programmable read only memory (EEPROM) device, such as the surface mount package identified by the designation 24LC256. This is a 256-kilobit device (thirty-two kilobytes) which communicates over an $I^2C$ interface. The device operates over a broad range of voltages (1.8 volts to 5.5 volts) and has hardware selectable $I^2C$ addressing by configuring analog pins. In order for data to be written, in addition to being read, a write protect pin is pulled low.

The $I^2C$ protocol uses a bus that is a standard bidirectional interface requiring a controller, referred to as the master, to communicate with slave devices. In accordance with this protocol, a slave may not transmit data unless it has been addressed by the master. Each device on the $I^2C$ BUS has a specific device address to differentiate between other devices that are on the same $I^2C$ BUS. Many slave devices require configuration data upon start up to set the behaviour of the device. This is typically done when the master accesses the slave's internal register maps, which have unique register addresses. A device can have one or multiple registers where data is stored, written or read. The physical $I^2C$ interface consists of a serial clock (SCL) line and a serial data (SCA) line. Both SCA and SCL lines are connected to a supply voltage through respective pull-up resistors, the size of which is determined by the amount of capacitance on the $I^2C$ lines.

Configuration data for individual devices is supplied from the control unit, when a control unit is attached. Given that control units are detached at the end of the shift, resulting in a configuration reset, a control unit must be reconfigured when re attached to an item of clothing, such as a harness or a jacket. The present invention therefore provides for the interface circuit to supply the configuration data to a connected control unit. In this way, it is then possible for the control unit to supply control data to the light emitting devices in accordance with the configuration data that itself has received from the interface circuit. For the light emitting devices, this configuration data specifies particular colors when multicolor devices are included. Configuration data is also required to specify flashing patterns when the light emitting devices are required to flash.

In an alternative embodiment, data storage device 102 may be implemented as a microcontroller. By providing a microcontroller, it is possible for this device to be responsible for operating light emitting devices forming part of the loom. The microcontroller would still be controlled by an external control box as an $I^2C$ slave device. However, offloading LED operation to the loom side frees-up the main controller to perform GPS/GSM related tasks. In an embodiment, the microcontroller could be implemented as an ATMEL ATtiny45. This provides four kilobytes of in-system programmable flash memory, 256 bytes of EEPROM and 256 bytes of SRAM. Six general purpose input/output lines are provided and the device has thirty-two general purpose working registers.

The selected microcontroller has the ability to have software selectable $I^2C$ addressing, which may assist in terms of reducing the risk of interference with other devices on the loom.

FIG. 2

The apparatus is provided with an IDC connector 201 for connecting to a control unit. A first plurality of wires 202 connect a removable control unit (by means of the IDC connector 201) to a first set of terminals 203 of the interface circuit 101. In an embodiment, the interface circuit may be placed approximately 30 to 50 millimetres after the IDC connector 201. The interface circuit 101 takes ten wires, in the form of a ribbon cable, from a control unit, to allow the routing of signals for various applications. In an embodiment, visual alerts are provided to an operative and, of a different type, to surrounding operatives. To achieve this, light emitting diodes are placed on an item of clothing. Thus, to facilitate this functionality, the interface circuit will output to a plurality of multi-colored addressable light emitting diodes. In addition, the data storage device allows any compatible control unit to be plugged in.

In this embodiment, the IDC connector 201 is universal to allow many configurations of looms to be attached to standard control units. In an embodiment, the interface supplied to the control units may be summarized as follows:

Pin 1: detect connection so that other pins may be polled;
Pin 2: 3-volt rail for digital electronics on the loom;
Pins 3 & 4: light emitting diode addresses;
Pins 5 & 6: the $I^2C$ bus;
Pin 7: an interrupt line for the $I^2C$ bus;
Pin 8: a 3.7-volt supply for other devices;
Pin 9: ground.

In this embodiment, the light emitting devices only use four pins, consisting of the 3.7-volt supply, ground and the two address pins.

A second plurality of wires 204, again implemented as a ribbon cable, are arranged to connect electrical equipment attached to the item of clothing to a second set of terminals 205 of the interface circuit 101.

The configuration of the first plurality of wires 202 remains substantially constant, to connect to a standard IDC connector 201 which in turn presents a standard interface to a control unit supportable within the item of clothing. However, the nature of the second plurality of wires 204 may change, to be consistent with the requirements of the item of clothing itself. Physical connections are made within the interface circuit to achieve this. However, in addition, operational instructions for the control unit attached to the apparatus are received from the connected interface circuit. To achieve this, the interface circuit includes a data storage device for storing operational instructions to control the functionality of the removable control unit.

The invention provides for an apparatus for inclusion within an item of clothing which takes the form of a fully functional loom having a plurality of addressable light emitting devices. In practice, a loom of this type would tend to be produced at a first factory and then transferred to a second factory for inclusion within an item of clothing. Thus, it is prudent to conduct a degree of testing upon the loom itself and then to conduct a further degree of testing after the loom has been incorporated within an item of clothing. Furthermore, it is possible for the data storage device to retain details of these tests should it become necessary to perform an audit at a later date. Following this theme, it is also possible for operational data to be retained when the item of clothing is in use which, from a safety perspective, may also provide a useful record when analysing the consistency of reported activities.

Chronologically, the data storage device would therefore receive data in the following order:

first test data from the loom factory for just the loom;
second test data for just the loom at the garment factory;
third test data for the loom included in a garment;
configuration data for the light emitting devices; and
operational data recording activities when in use.

FIG. 3

Figure 3:
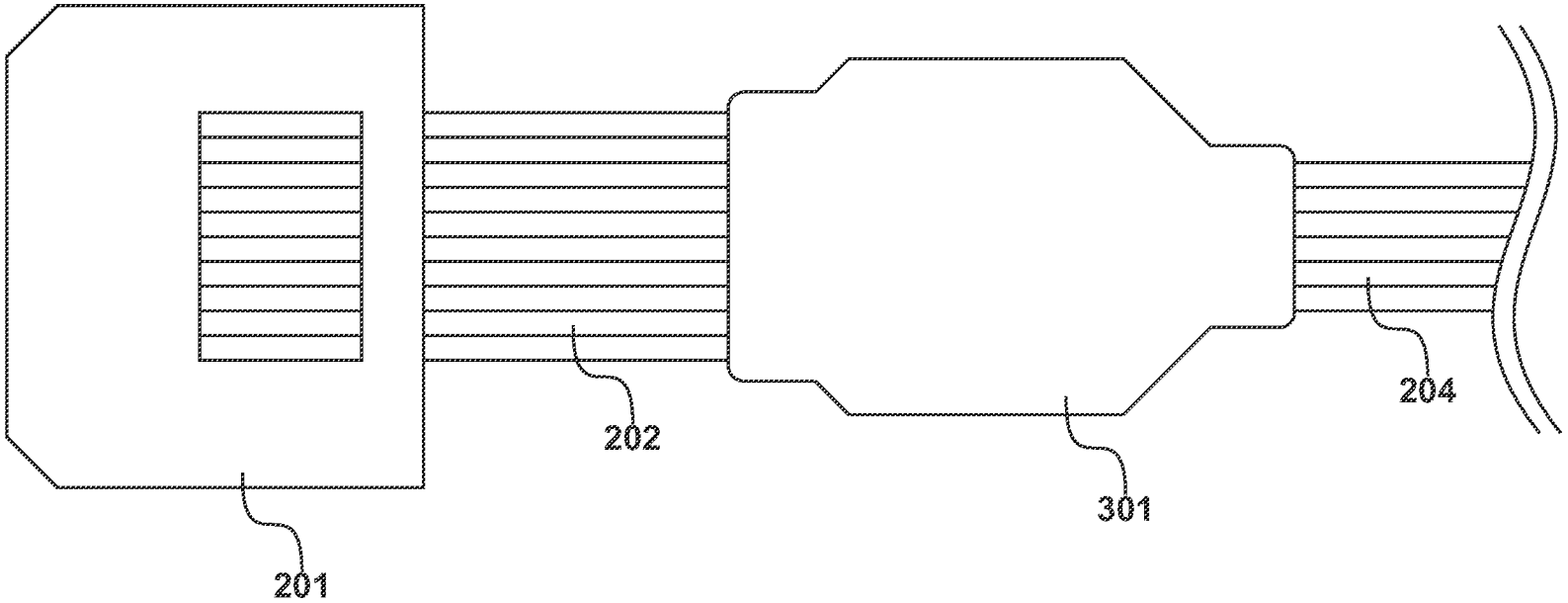
FIG. 3 shows the encapsulation of the interface circuit identified in FIG. 2.

As illustrated in FIG. 3, in an embodiment, the interface circuit 101 is encapsulated to protect the first set of terminals and the second set of terminals. In particular, the interface circuit is over moulded, to prevent water ingress, by an over moulding 301. The over moulding 301 should protect the interface circuit, allowing it to withstand a washing cycle at temperatures of up to sixty degrees Celsius. However, the encapsulated interface circuit is embedded within an item of clothing, therefore it does not need to be protected against outside elements.

A printed circuit board for the interface circuit may be constructed from FR4 PCB material and the integrated circuit placed on this circuit board is preferably of a low-profile configuration. The circuit board also provides pads defining the first set of terminals 203 and the second set of terminals 205, which are preferably large enough to allow ribbon cable wires to be hand soldered. Furthermore, it is appreciated that the interface circuit represents a first piece of the loom that is encountered after connector 201, therefore care should be exercised to provide sufficient stress relief such that, in use, force from an operative should not cause wires 202 to separate from terminals 203.

FIG. 4

Figure 4:
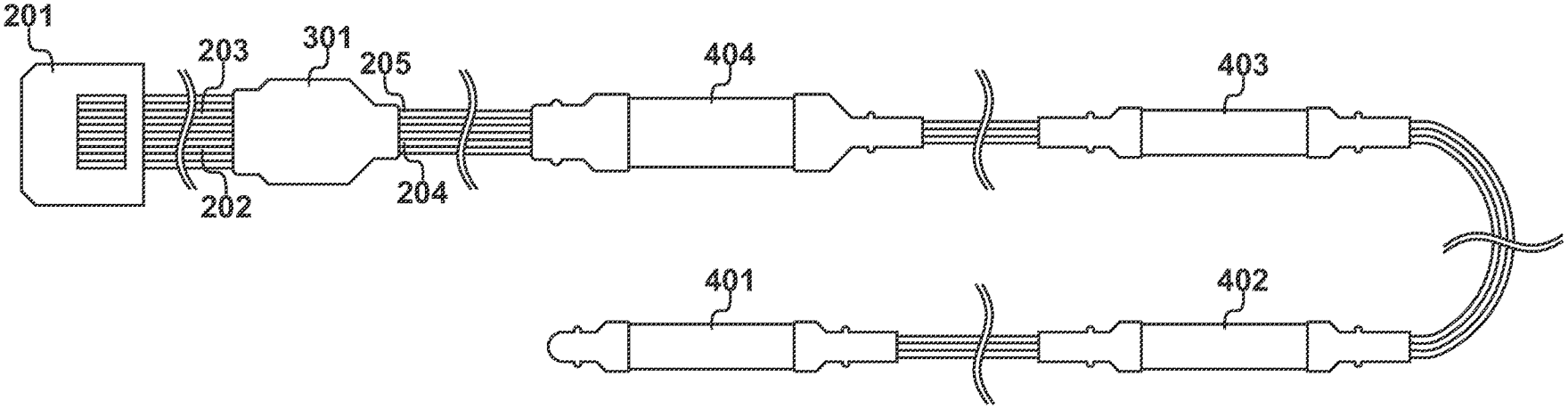
FIG. 4 shows a complete apparatus for inclusion within an item of clothing.

An apparatus for inclusion within an item of clothing is illustrated in FIG. 4, wherein the item of clothing itself is configured to enhance visibility and support electrical equipment. Encapsulated interface circuit 301 has a first set of terminals 203 and a second set of terminals 205. A first plurality of wires 202 are arranged to connect a removable control unit (via connector 201) to a first set of terminals 203. A second plurality of wires 204 are arranged to connect electrical equipment to a second set of terminals 205. The interface circuit 301 includes a memory device for storing operational instructions for influencing the functionality of a removable control unit.

In this example, electrical equipment includes a light emitting diode printed circuit board strip 401 with an integrated sensor. In addition, three similar light emitting strips (without sensors) 402, 403 and 404 connect to the interface circuit 301.

The electrical components are connected via a ribbon cable, presenting a series configuration with a connector on one end. The apparatus is intended to be of a modular design and therefore allows for multiple light emitting strips to be added. In this embodiment, the integrated sensor, within strip 401, is used to detect ambient light conditions. Thus, the interface circuit allows for different configurations of apparatus without requiring significant modification.

FIG. 5

Figure 5:
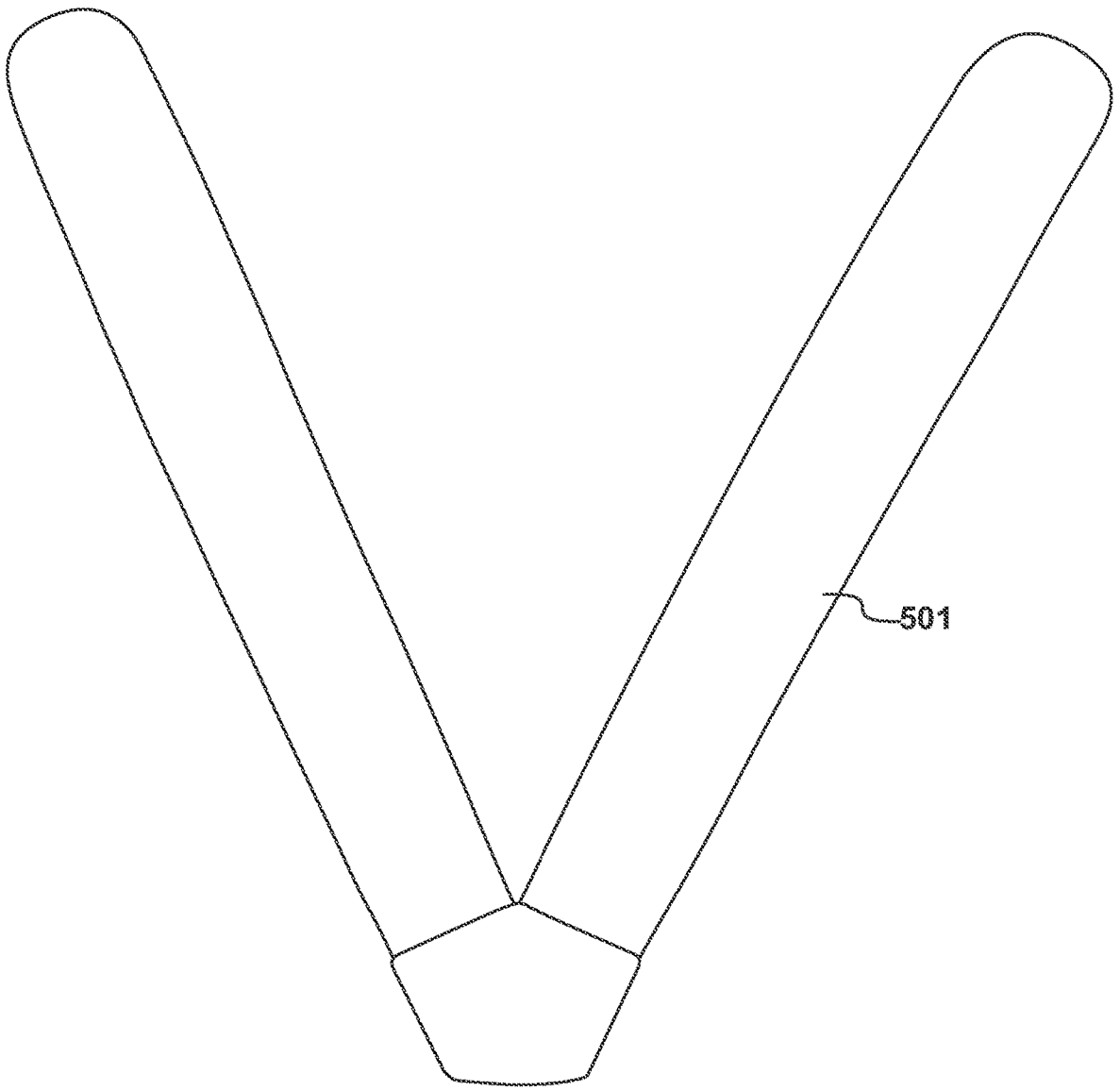
FIG. 5 shows a base layer for a first subassembly.

A base layer 501 for a first subassembly of a harness is illustrated in FIG. 5. This base layer 501 provides mechanical integrity for the clothing item and does not assist directly with enhancing visibility.

FIG. 6

Figure 6:
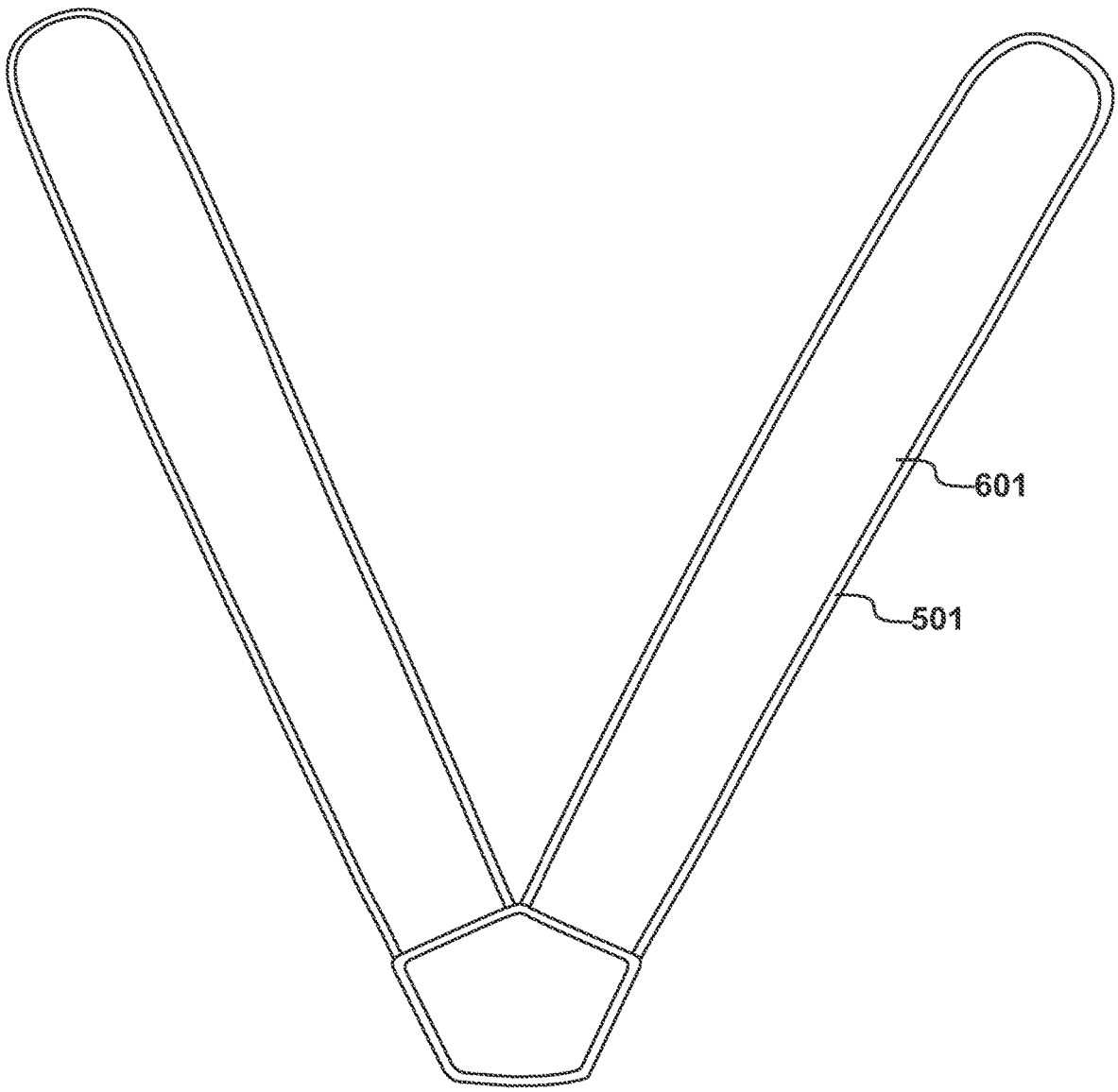
FIG. 6 shows a fluorescent material added to the base layer identified in FIG. 5.

As illustrated in FIG. 6, a fluorescent material 601 is attached to the base layer 501, possibly by stitching. The fluorescent material 601 enhances visibility in daylight conditions and is often provided in either a fluorescent green color or a fluorescent orange color.

FIG. 7

Figure 7:
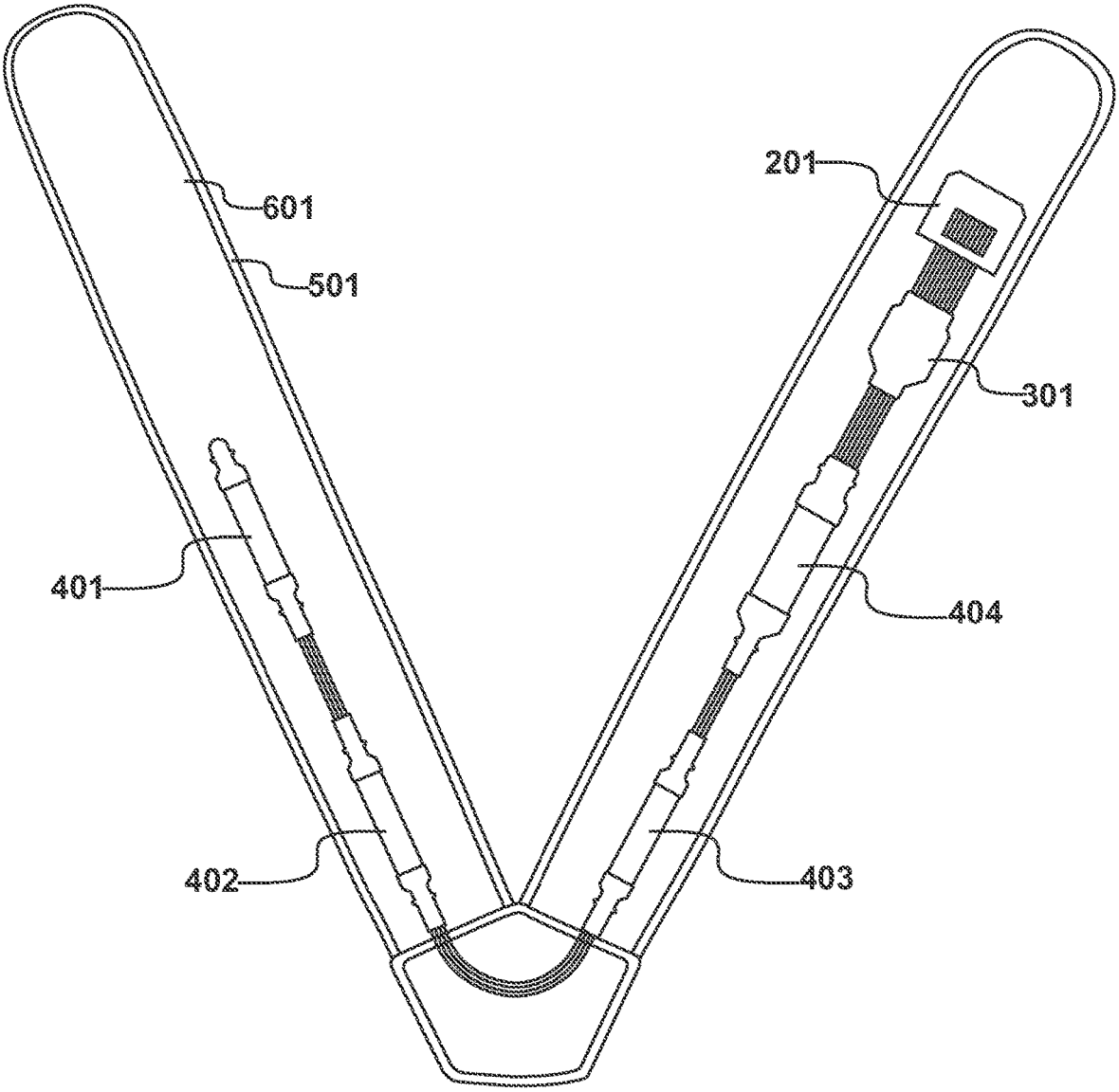
FIG. 7 shows the addition of electrical equipment to the fluorescent material identified in FIG. 5.

As illustrated in FIG. 7, the loom apparatus of FIG. 4, including the interface circuit 301 and the light emitting strips 401 to 404, is incorporated with the first subassembly, consisting of layers 501 and 601, shown in FIG. 6.

FIG. 8

In an embodiment, the method of assembly also includes the step of applying an outer strip 801 of an optically reflective material to enhance visibility in response to artificial light. Upon strip 801, embossed areas 802 are defined to indicate positions for manually interactive components retained under the strip and configured to supply data via a suitable interface.

In this embodiment, the outer strip 801 is attached to the hi-visibility material 601 that surrounds the strip while at the same time still revealing a portion of the hi-visibility material to enhance visibility in daylight. The strip 801 of optically reflective material has a first long edge 803 and a second long edge 804. The strip is secured to the base material 501 along the first long edge 802 and along the second long edge 804 to define a channel between the strip 119 and the base material 501. Thus, it is then possible to retain the electrical apparatus within this channel.

FIG. 9

Figure 8:
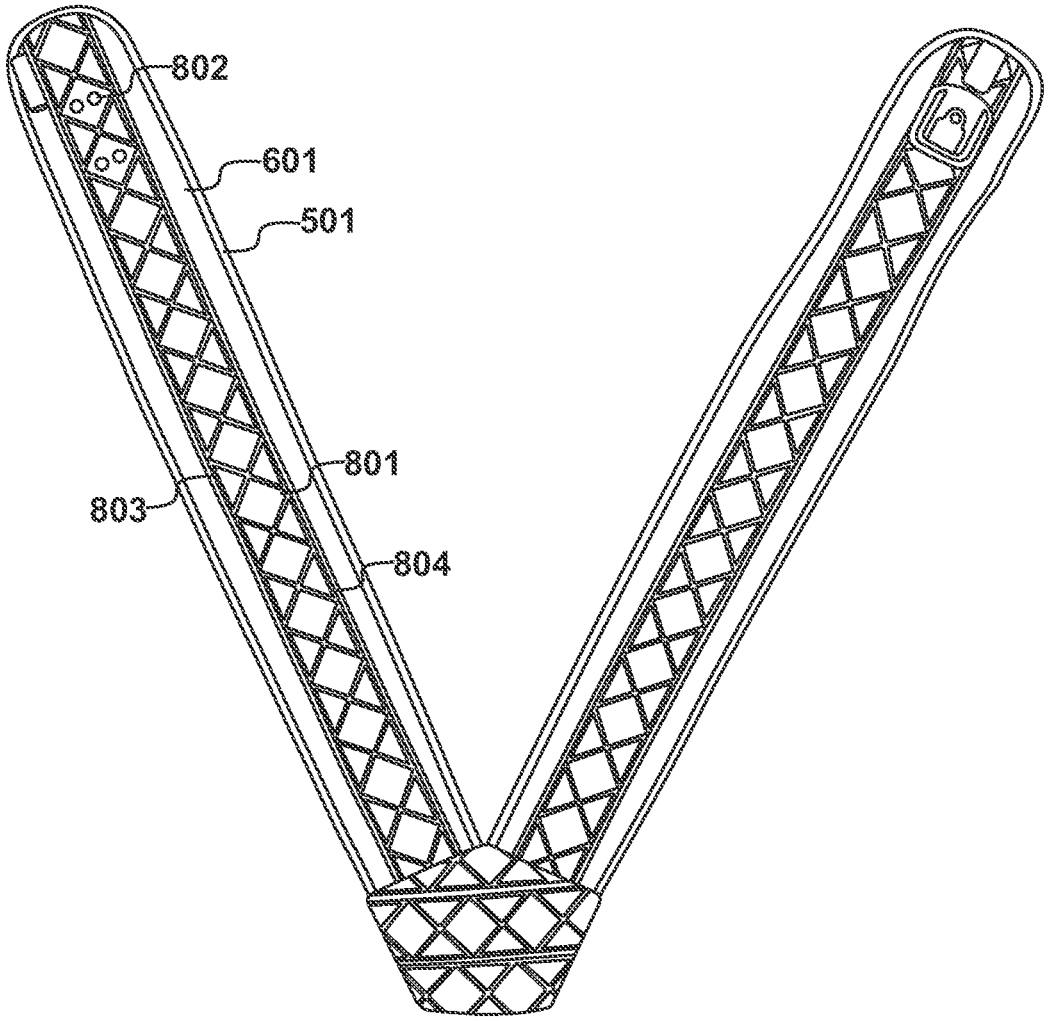
FIG. 8 shows the application of an outer strip.
Figure 9:
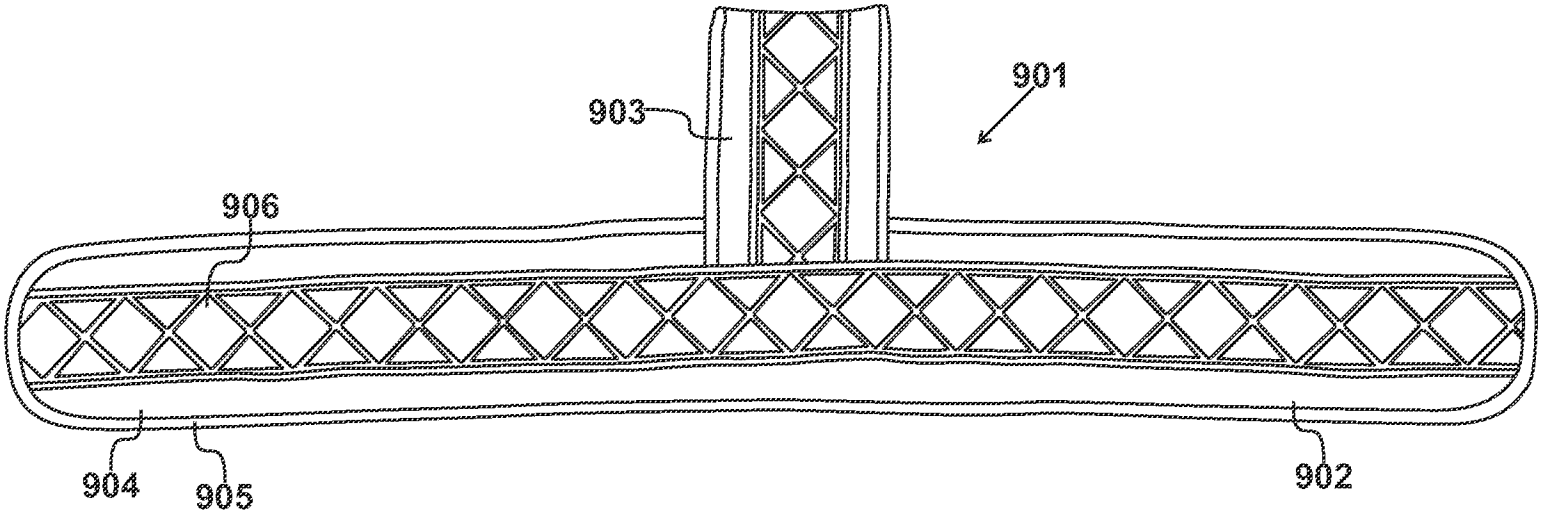
FIG. 9 illustrates a second subassembly.

The embodiment also includes the step of assembling a second subassembly 901, as illustrated in FIG. 9. The second subassembly 901 has a substantially inverted T-shape configuration, with a substantially horizontal section 902 and a substantially vertical section 903 connected between a substantially central position of section 902. After assembly, vertical section 903 is also connected to the first subassembly, described with reference to FIG. 8.

The construction of the second subassembly is substantially similar to the construction of the first subassembly, without the inclusion of any electrical components. Thus, a florescent material 904 is attached to a base material 905. This is then covered by a reflective strip 906.

FIG. 10

Figure 10:
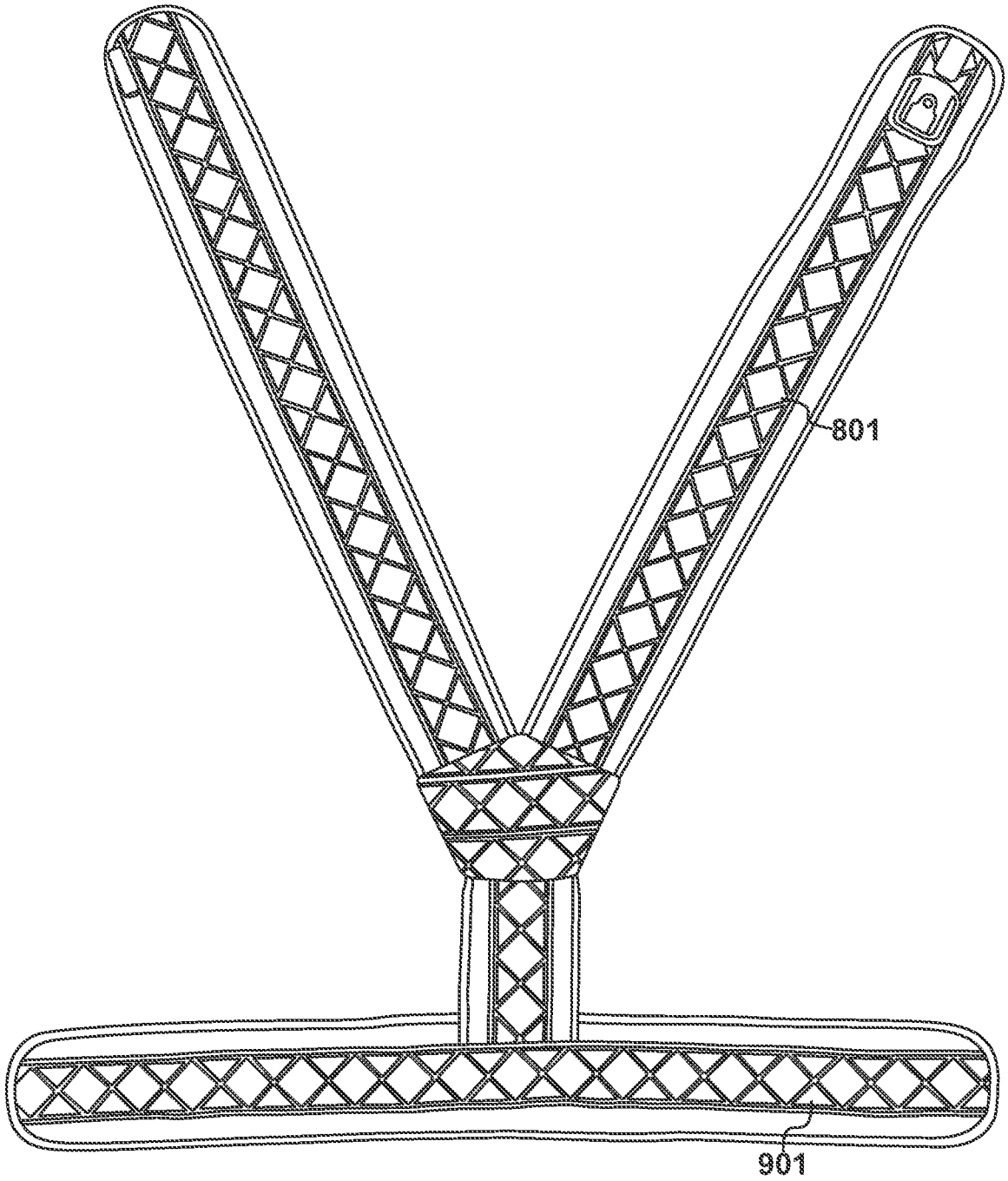
FIG. 10 illustrates the connection of the first subassembly to the second subassembly.
Figure 11:
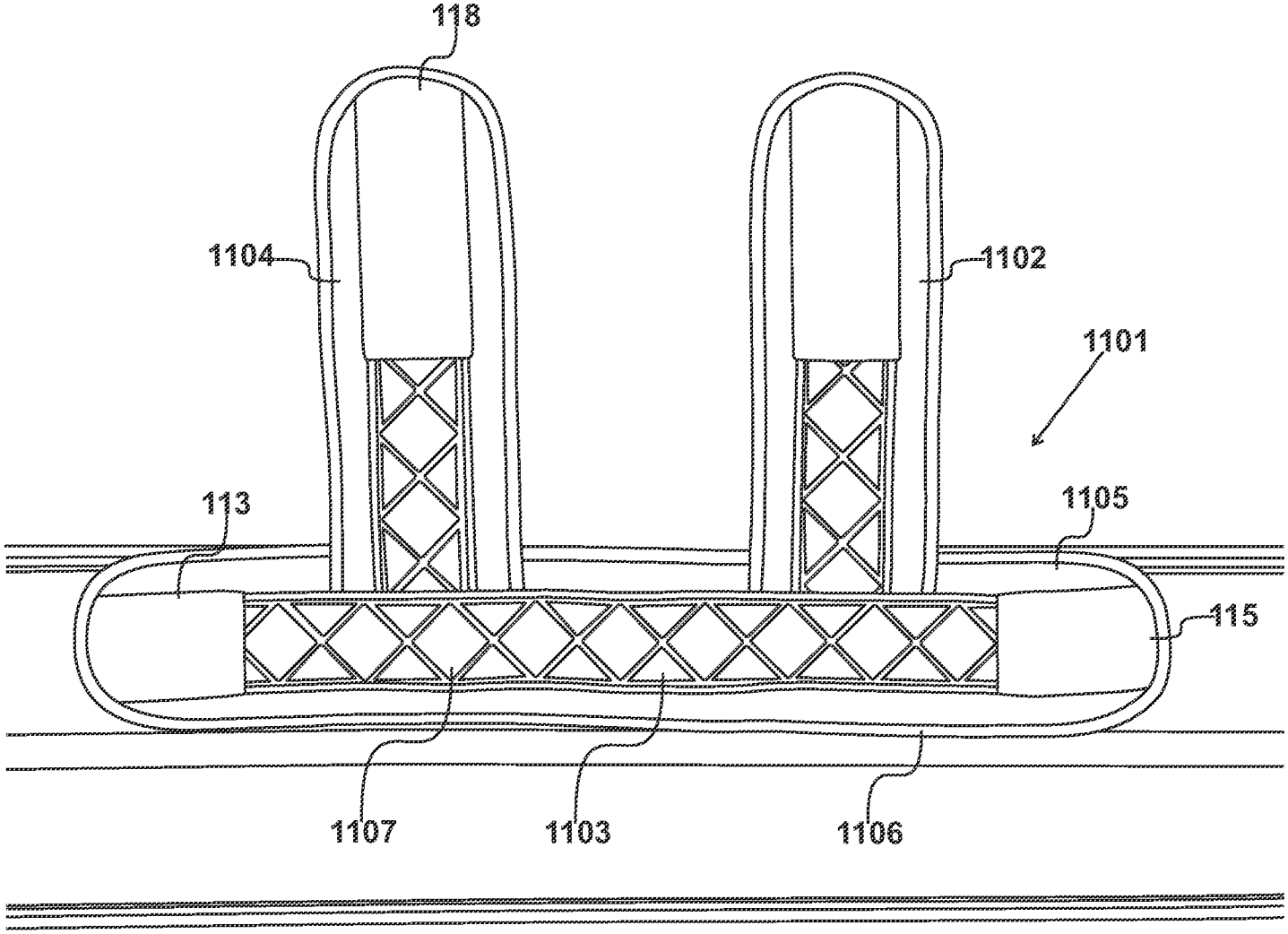
FIG. 11 illustrates the creation of a third subassembly.
Figure 12:
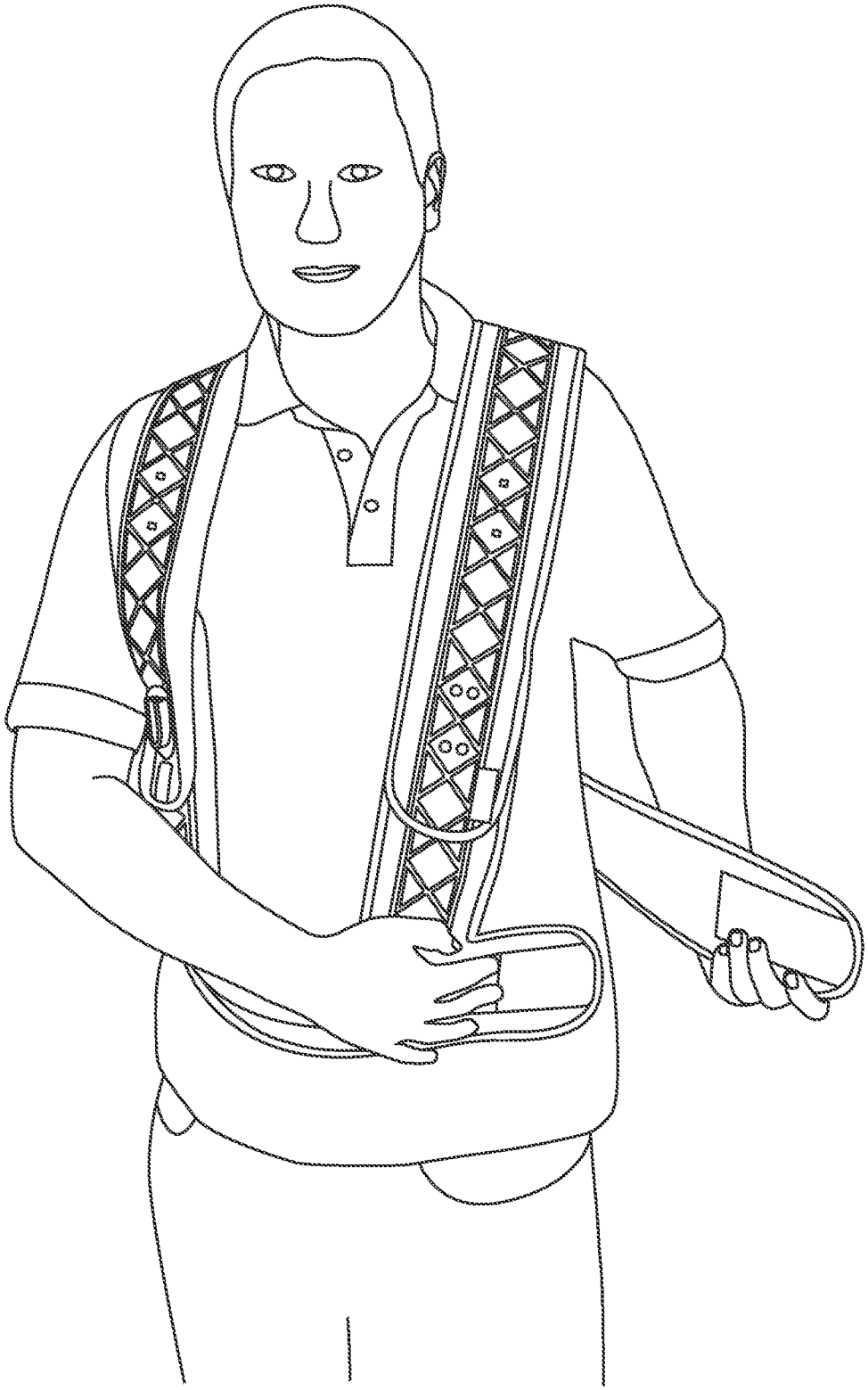
FIG. 12 shows an assembled apparatus being deployed.
Figure 13:
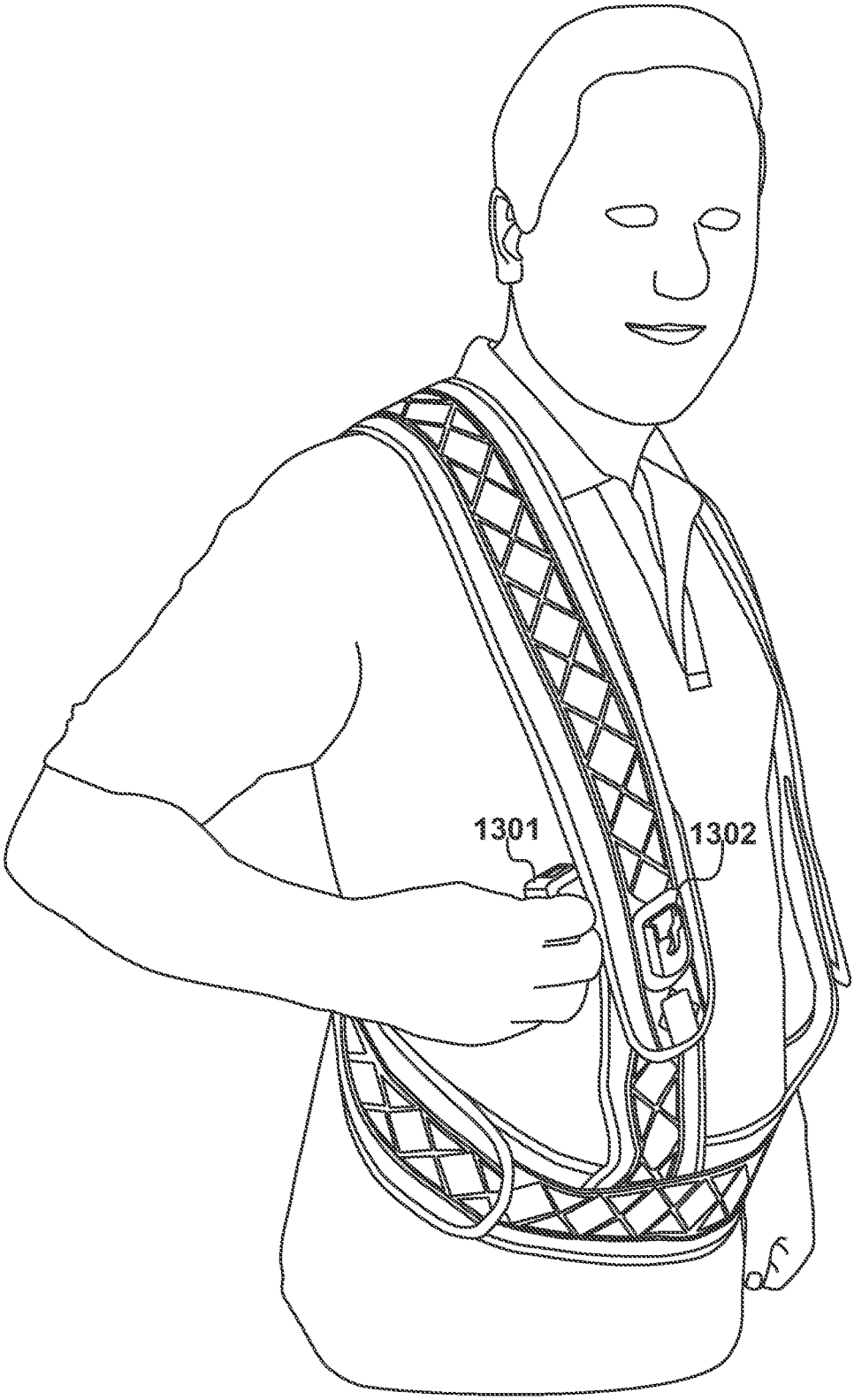
FIG. 13 shows the addition of a control box.

As illustrated in FIG. 10, the second subassembly 901 is attached to the first subassembly 801. To enhance the manufacturing procedure, sophisticated techniques are deployed using the production of the first subassembly that includes the electrical equipment. Thus, when constructing this first subassembly, care must be exercised to ensure that the electrical connections are not damaged in any way and that the integrity of the device is maintained. Furthermore, in an embodiment, test data is generated and stored both before the loom is included within the item of clothing and after the loom has been included in the item of clothing. Such requirements do not exist during the manufacture of the second subassembly, which can be produced under totally different operating conditions. The two components are then brought together, as illustrated in FIG. 10.

In an embodiment, all sizes are provided for using first subassemblies and second subassemblies of substantially similar dimension. Thus, all sizes will include an intermediate assembly of the type shown in FIG. 10, with no size variation between examples. In this way, stock keeping demands are reduced significantly, while still providing size variation and adjustment to operatives.

FIG. 11

To provide adjustability, a third subassembly 1101 is provided having a substantially inverted pi configuration, with a first substantially vertical element 1102 extending from a substantially horizontal element 1103, along with a second substantially vertical element 1104 extending from the substantially horizontal element 1103.

The construction of a third subassembly is substantially similar to that of the first subassembly. In particular, a fluorescent material 1105 is attached to a base material 1106. Thereafter, an outer strip 1107 of an optically reflective material is applied to enhance visibility in response to artificial light. However, the third subassembly does not include any electrical equipment.

FIG. 12

When deployed, the third subassembly 1101 is present at the front of the operative, with a vertex portion at the rear. It is therefore appreciated that relevant graphical insignia could be deployed upon the vertex portion.

The third subassembly may be attached using a conventional hook and eye system, often sold under the trademark Velcro®. Relatively small portions of hooking material may be deployed on the first subassembly and the second subassembly, with a larger proportion of the hooked material applied on the third subassembly. Thus, in this way, a first end of the first subassembly is attached to a first end of the third subassembly. Similarly, a second end of the first subassembly is attached to a second end of the third subassembly. Finally, the apparatus is made secure by attaching the second end of the horizontal section to the second end of the horizontal element.

FIG. 13

In an embodiment, the apparatus includes a pocket for receiving a control unit 1301. The control unit includes a power supply. Prior to inserting the control unit 1301 into an internal pocket, the control unit is physically connected to connector 201. Thereafter a configuration process occurs between the control unit and other equipment forming part of the loom, before the combination becomes fully operational.

The control unit 1301 includes a processor, such as a micro-controller, interfaced to data cables forming part of the loom, via the interface circuit 101. Furthermore, the control unit 1301 may include a wireless transmission device for communication with external equipment and for communication with peripheral equipment.

The first subassembly includes a mechanical support device 1302 for supporting a peripheral device. In an embodiment, the mechanical support device 1302 also includes a termination for supplying power to the peripheral device. However, in an embodiment, communication between the control unit 1301 and a peripheral device occurs wirelessly, possibly by deploying Bluetooth low energy protocols.

FIG. 14

Figure 14:
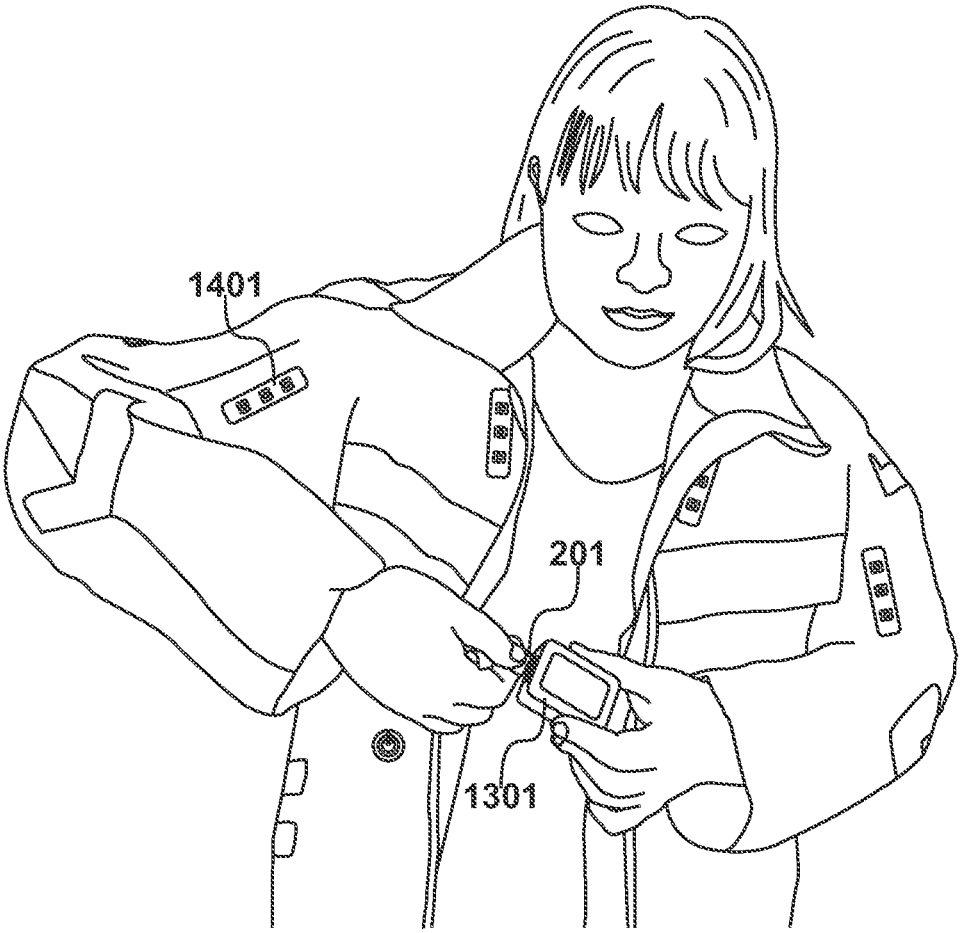
FIG. 14 shows a loom being connected to a control unit.

After a control unit 1301 has been charged, it is connected to a wiring loom connector 201, to be in a position to power the active devices, such as light emitting indicating device 1401, forming part of the wearable item, illustrated as a jacket in FIG. 14. After being connected in this way, the control unit has not been activated and may remain in a minimal energy dissipation state until manually activated.

FIG. 15

Figure 15:
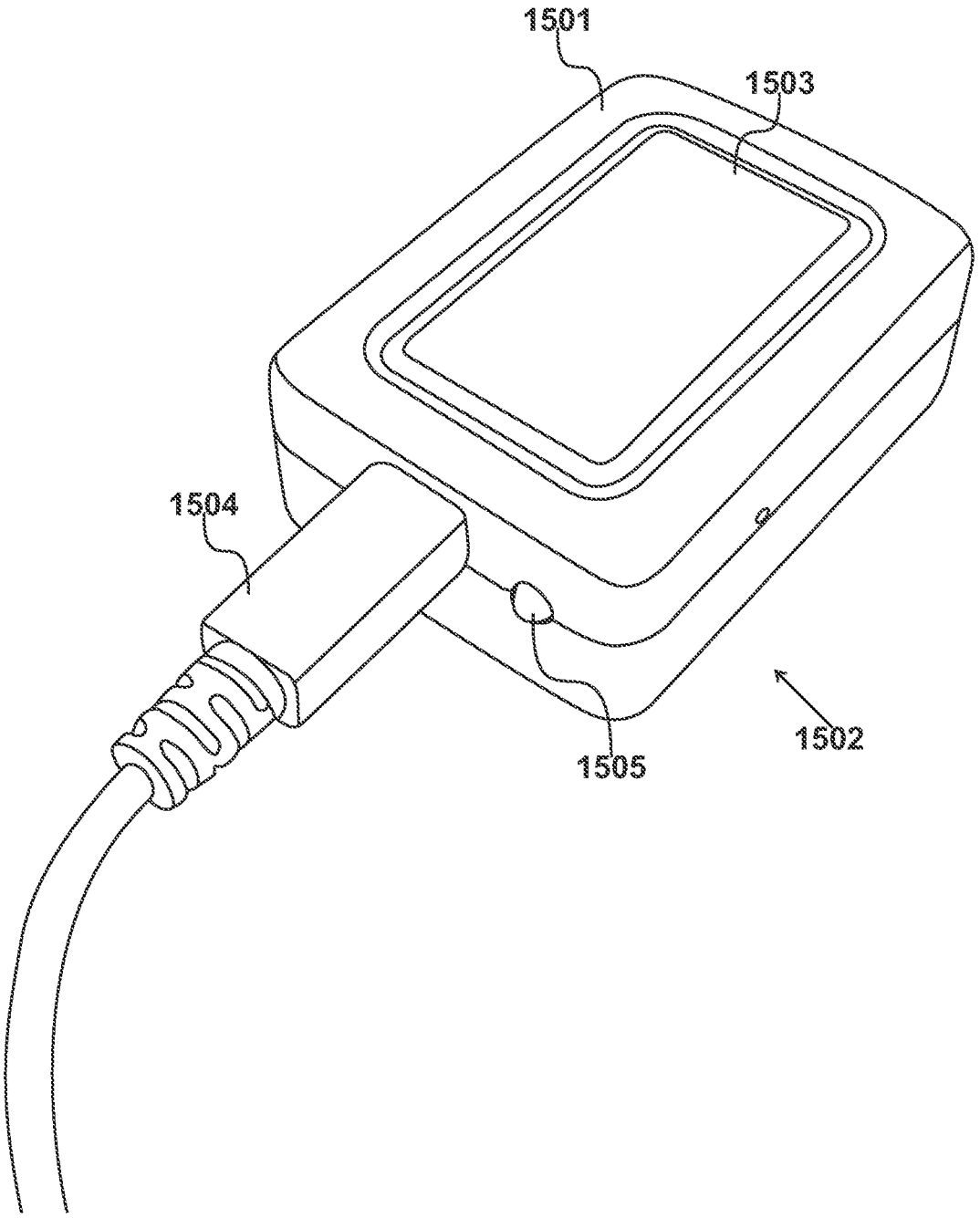
FIG. 15 details the control unit identified in FIG. 14.
Figure 16:
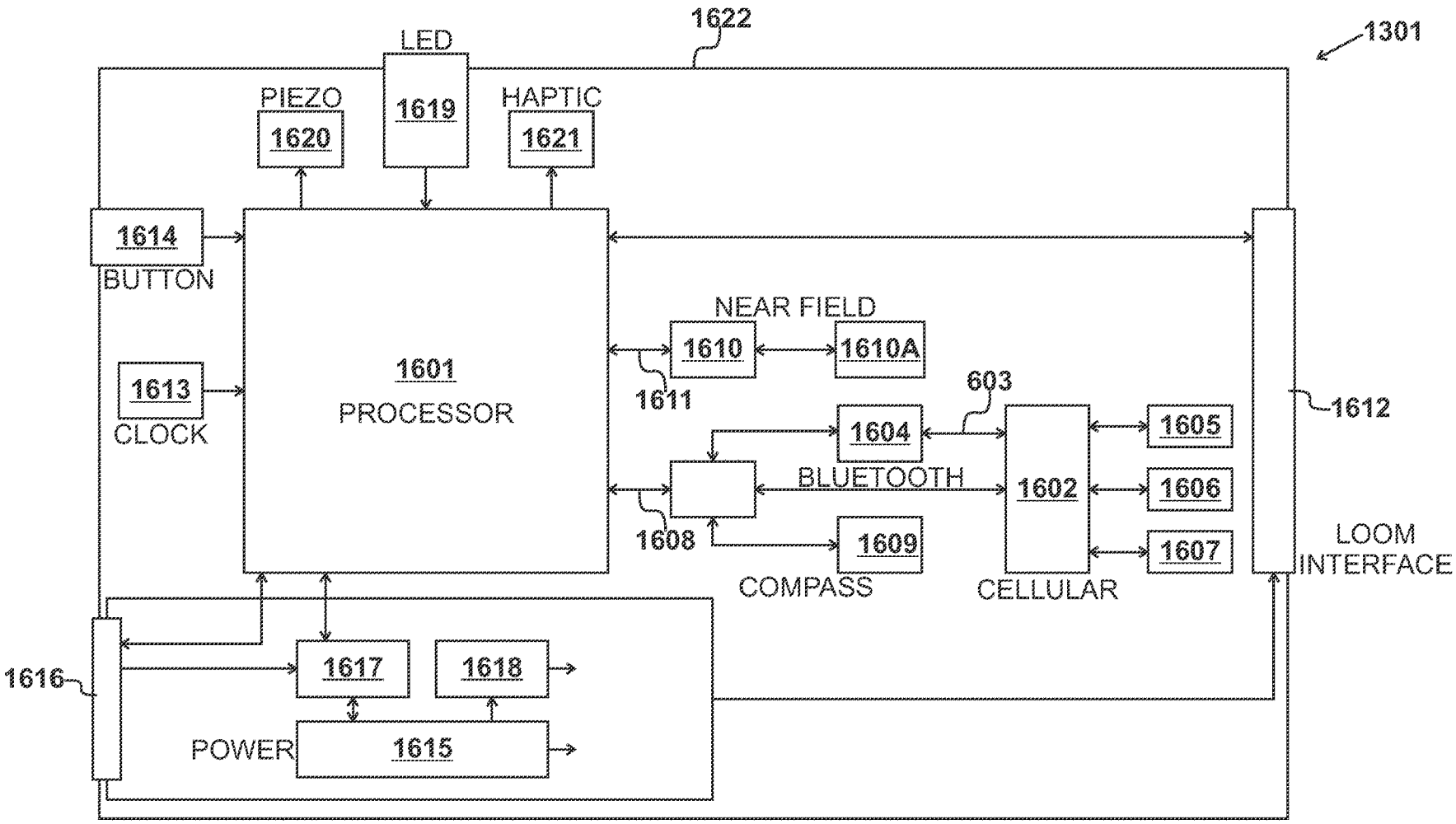
FIG. 16 shows a schematic representation of modules within the control unit identified in FIG. 15.

The control unit 1301 has a first surface 1501 and an opposing second surface 1502 (not visible in FIG. 15). An activation button 1503 is provided that covers more than 40% of the surface area of the first surface 1501 and, in an embodiment, covers 70% of the first surface area. Furthermore, a visual indicator is provided on the outside surface of the item of clothing at a position of the pocket. In this way, the visual indicator indicates the position of a portion of the activation button when a control unit is present within the pocket. Thus, the size of the activation button relative to the size of the control unit itself allows a loose fit within a pocket, such that the control unit may move with respect to the visual indicator on the jacket itself. However, given the size of the button, even when this movement takes place, a significant portion of the button 1503 will still be located adjacent to the visual indicator, thereby facilitating activation and deactivation without removing the control unit.

In the embodiment shown in FIG. 15, the control unit includes rechargeable batteries that receive charge via a conventional USB cable 1504. A light emitting device 1505 may glow red when the device is charging and may glow green after the device has become fully charged.

FIG. 16

The control unit 1301 communicates with peripheral devices attached to the item of clothing. The control unit includes a processor 1601 that may be implemented as an STM32 microcontroller. This provides a significant processing capability, while minimising power demands, as required for the cellular and local communications that take place.

A cellular communication module 1602 is provided for communicating with a remote base station. The cellular communication module 1602 may be a SIMCOM module providing G3 GSM and enhanced GPRS connections, along with GPS tracking. A digital communication link 1603 provides digital audio to a dual Bluetooth module 1604, capable of operating in classic Bluetooth mode, for the provision of audio communication with a Bluetooth headset while, in addition, being capable of operating in accordance with Bluetooth low energy protocols for communicating with peripheral devices.

The cellular communication device 1602 is provided with a GSM antenna 1605, a GPS antenna 1606 and a cellular SIM card 1607. An asynchronous digital communication channel 1608 allows the processor 1601 to communicate with the cellular communication module 1602, the dual Bluetooth module 1604 and an E-compass module 1609. In an embodiment, the E-compass module 1609 is used to identify falls and other movements made by an operative. In further embodiments, the E-compass module could also be deployed for dead-reckoning purposes, allowing the tracking of operatives to continue when indoors or in other environments when a GPS signal is not available.

A near field radio communication module 1610 is provided with its own NFC antenna 1610A. Again, a digital communication link 1611 allows communication between the near field radio communication module 1609 and the processor 1601.

When operational, the processor 1601 controls the near field radio communication module 1609 to read a first code from a peripheral device. The processor then controls the cellular communication module 1602 to transmit this first code to the remote base station. The near field radio communication module is controlled again to read a second code from an item of clothing. The cellular communication device is again controlled to transmit this second code to the remote base station. It is then necessary to wait for a positive determination from the base station.

Assuming a determination is positive, an access address is received from the remote base station via the cellular communication module 1602. This access address data is of a type used to perform an end-of-shift data download from the peripheral device and by making repeated use of this, it is possible to achieve a near real-time operation of the device without in any way changing its operational characteristics. Thus, the access address is used periodically to demand the download of data from the peripheral device, via the dual Bluetooth module 1604, which is then relayed to the base station via the communications module 1602.

In an embodiment, a physical interface 1612 is provided, implemented as an IDC connector, for supplying power and data to embedded devices connected to a loom embedded within the item of clothing. These embedded devices include light emitting devices. In an embodiment, the embedded devices also include light detecting devices, wherein the light emitting devices are controlled in response to output signals from the light detecting devices. Furthermore, upon receiving a positive determination to allow access to the peripheral device, the processor 601 may be configured to cause the light emitting devices to flash, thereby confirming to an operative that the system has become functional.

In this embodiment, a clock signal to the processor 1601 is provided by a twelve-megahertz's crystal 1613. In an embodiment, operation of a single large button 1614 will change light emitting diode flash rates with a single short press and will allow the brightness of the light emitting devices to be changed if double clicked. Furthermore, it may activate an alarm if pressed and held for more than three seconds.

A lithium polymer cell 1615 is charged from a micro USB input 1616 via a charge controller 1617. A regulated output of three volts is also provided by a regulator 1618, in addition to a direct output, that typically has a voltage of around 3.7 volt.

A light emitting indicator 1619 provides an indication of charging conditions. Thus, the indicator 1619 may glow green when charging and then glow red when fully charged. Consequently, operatives would be encouraged to select control units that indicate a green condition.

A piezo electric device 1620 provides audible alerts of typically 90 dB. A short beep may also be used to acknowledge pairing of Bluetooth devices and dangerous situations may be identified by constant long beeps, in addition to audio messages transmitted to a Bluetooth headset.

A haptic motor 1621 provides haptic feedback and notifications, that are considered to be particularly useful in noisy environments. To enhance results, the haptic motor is mounted directly to an enclosure 1622 of the control unit.

Processor 1601 operates in accordance with stored instructions that are relevant for a particular type of attached apparatus. In an embodiment, a plurality of sets of instructions are stored locally, so that each control unit can be attached to several different types of apparatus. Thus, for example, different types of apparatus may include different numbers of LED devices and may or may not include additional equipment, such as ambient light detectors. A selection is then made based on operational instructions received from the memory device contained within the interface circuit.

FIG. 17

Figure 17:
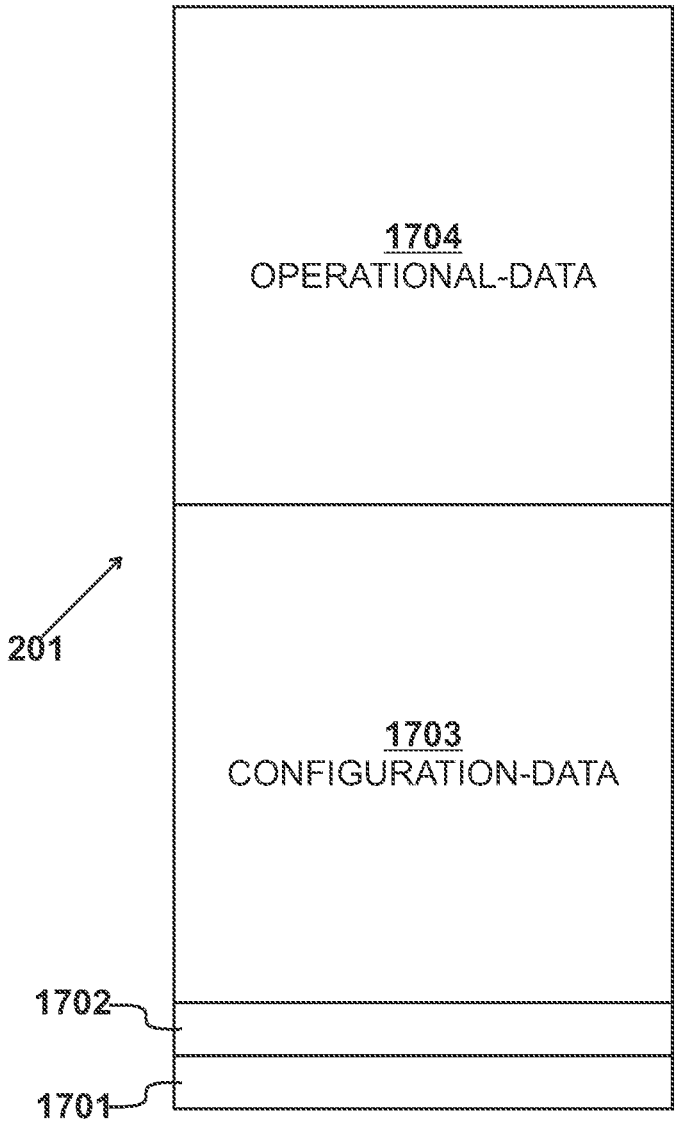
FIG. 17 shows a memory map for the data storage device.

A memory map for the data storage device 102 is illustrated in FIG. 17. In an embodiment, the data storage device has a capacity of thirty-two kilobytes. A first region 1701 of one-kilobyte of the available storage is reserved for first test data produced at the loom factory. A second region 1702 of one-kilobyte of the available memory is reserved for second data and third data produced at the garment factory. Thus, looms may be tested at the garment factory before they are inserted within the garment and then further tests may be performed after the looms have been inserted within the garment.

A third region 1703 of fifteen kilobytes is reserved for the configuration data. This is read by an attached control unit which then drives the light emitting devices in accordance with the data the has been received. In the absence of this data, a default setting is incorporated within control units themselves. Thus, when configuration data is available, this effectively overwrites the default settings and allows bespoke light activation routines to be developed, in terms of the color of the lights and the light flashing cadences.

It is appreciated that in some environments, particular colors of light are to be avoided. In transportation systems for example the colors red and green are avoided, given that these colors are used for providing stop and go indications. Orange clothing and amber or white light emitting devices are preferred. In other environments, such as when dealing with potentially hazardous chemicals, red lights are preferred given that rapid-evacuation protocols may be in place.

A fourth region 1704 thirty-one kilobytes is reserved for operational data. This provides sufficient capacity for data to be stored for a twelve-hour operational shift, on an item of clothing typically having four sensors producing a unit of data for each operational minute. Thereafter, at the end of the shift, the operational data is downloaded and the fourth region 1704 is then available for the next operational shift.

FIG. 18

Figure 18:
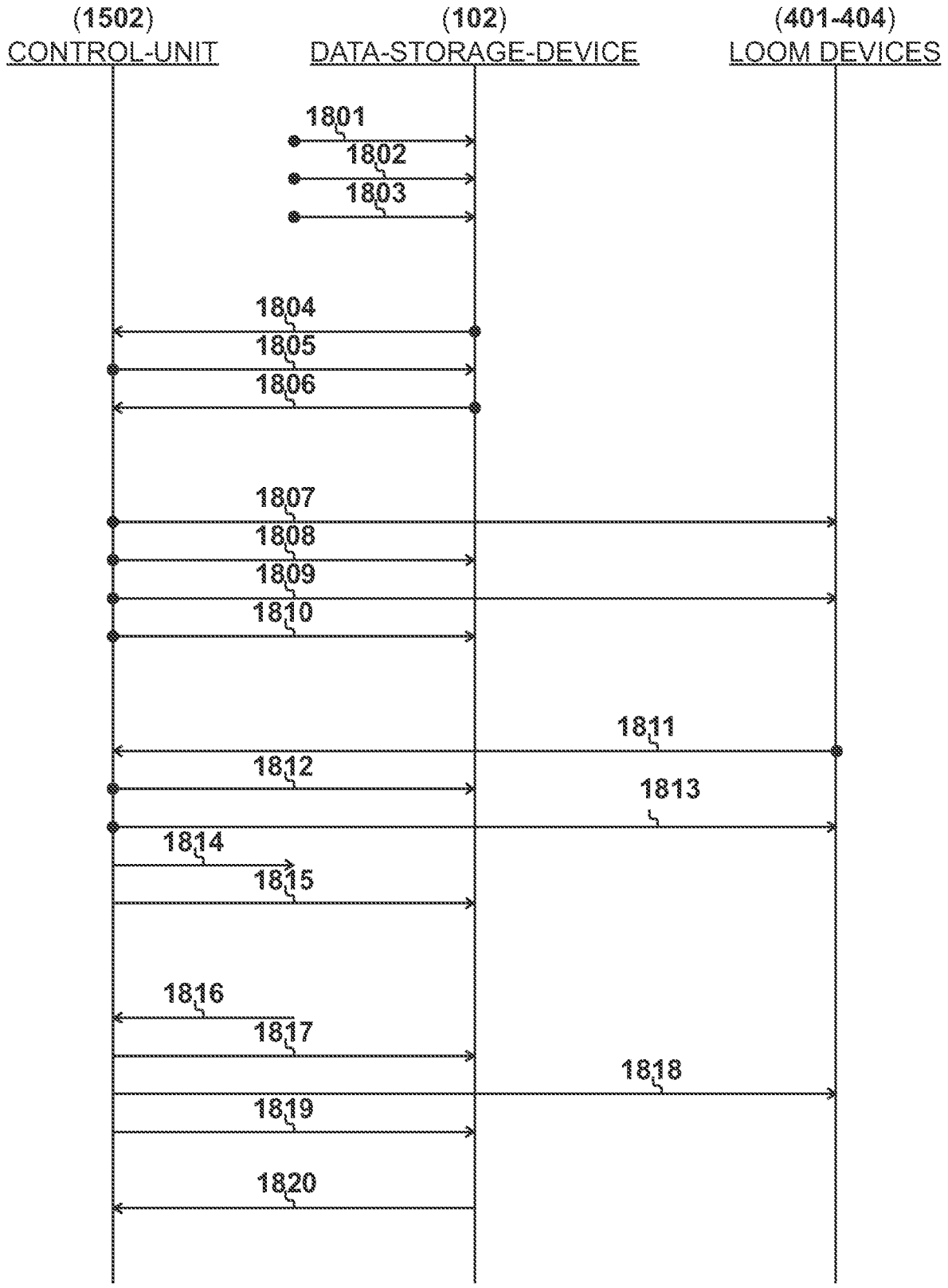
FIG. 18 shows a protocol diagram.

A protocol diagram illustrating communications between a control unit (1502), a data storage device (102) and loom devices (401 to 404) is illustrated in FIG. 18.

At the loom factory, first-test-data 1801 is written to the data storage device 102 after performing initial tests. Thereafter, the assembled loom is transferred to a garment factory where second-test-data 1802 is transferred to the data storage device 102 after performing a first test before the loom is installed. Thereafter, third test data 1803 is written to the data storage device after further testing has been performed with the loom installed within the garment. Garments, with looms installed, are now despatched for use by operatives.

Before the garment may be used in the field, a control unit is connected, as described with reference to FIG. 14. This results in the generation of a connection-detect signal 1804 transmitted from the data storage device 102 to the control unit 1502. In response to receiving this connection-detect signal 1804, the control unit 1502 issues a data request 1805 to the data storage device 102. In response to receiving the data request 1805, the data storage device 102 transmits configuration data 1806 to the control unit. The configuration data is installed at the control unit 1502 which now places the overall assembly in a position to be used in the field.

Operation of the loom devices 401 to 404 may take place under three different operational conditions. Firstly, during normal operation, it is possible for operatives to manually select operation of the loom devices, usually in a constant mode or in a flashing mode, unless either of these modes has been disabled by specific configuration data. By default, when operating in this mode, the light emitting devices will illuminate white and when selected to flash, a simple on/off repeated cadence for all of the white lights may take place.

A second of these conditions may be identified as a warning. This represents a notification to the effect that a message has been sent. The condition therefore represents a situation where the operative should be made aware of something but it is not necessary to evacuate.

The third condition may be identified as an alarm, meaning that the operative should evacuate the area as soon as possible.

For the purposes of this illustration, it is assumed that a local device attached to the loom identifies an emergency condition. First-alarm-condition-data 1811 is transmitted from the loom device to the control unit 1502. Again, this results in third-operational-data 1812 being written to the data storage device 102. Thereafter, third-device-activation-data 1813 is transmitted from the control unit to the loom devices. Thus, under these conditions and in accordance with the configuration data, light emitting devices on the loom may be caused to flash red and audio warnings may also be generated. In addition, the control unit 1502 transmits external-data 1814 and again this position is recorded by fourth-operational-data 1815 written to the data storage device.

Again, for the purposes of illustration, it is assumed that an emergency condition has been identified by another operative working within the environment. In response to this condition, the control unit 1502 receives second external data 1816. Fifth operational data 1817 is written to the data storage device 102, confirming that the second external data has been received. Thereafter fifth operational data 1718 is transmitted from the control unit to the loom devices, again causing the loom devices to operative. In an embodiment, a local emergency condition results in light emitting devices being caused to flash red. In order to distinguish the type of condition detected, in an embodiment, an external remote alarm conduction results in the light emitting devices being caused to flash blue. Thus, the blue flashing devices may be interpreted by an operative to show that they themselves are not in immediate danger but a colleague may require assistance and a complete evacuation may be appropriate. Again, sixth operational data 1819 is written to the data storage device 102 confirming that the blue flashing of the light emitting device has been activated.

At the end of the shift, bulk operational data 1820 is transferred to the control unit 1502. The control unit is then responsible for conveying this bulk data to a central data processing system. Thereafter, the control unit 1502 is disconnected and returned to a charging station, resulting in the control unit being reset, such that it may be selected and reconfigured by any operative at the start of the next shift.

FIG. 19

Figure 19:
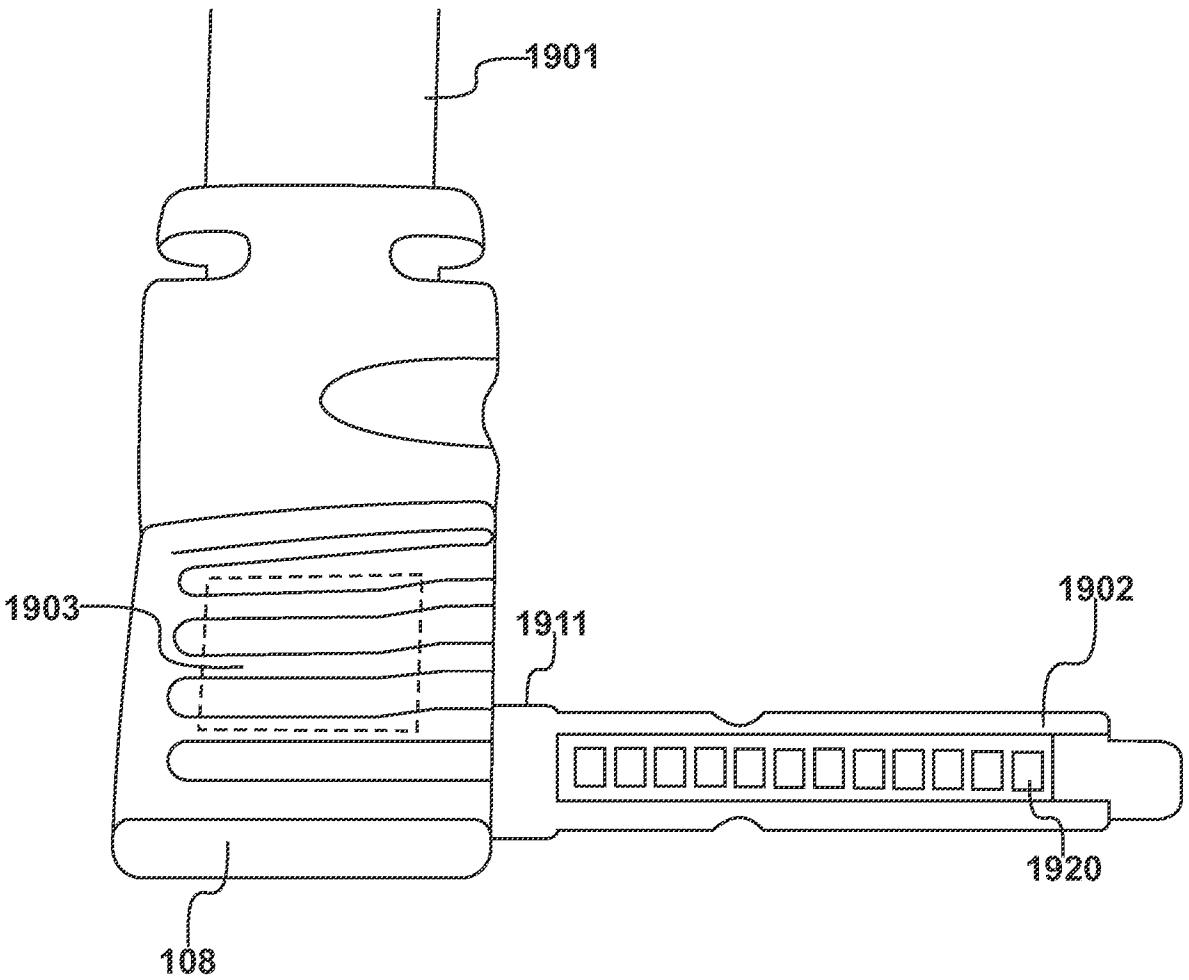
FIG. 19 shows an apparatus for inclusion within an item of clothing.

A further example of an apparatus for inclusion within an item of clothing is illustrated in FIG. 19. The item of clothing is configured to enhance visibility and support electrical equipment. It includes addressable light emitting devices and a loom 1901 for supplying power and control data from a control unit to the light emitting devices. An interface circuit is connected to the loom which includes a connector in the form of a control unit plug for releasably connecting to a control unit, as described with reference to FIG. 20. The interface circuit includes a data storage device 1903, substantially similar to the device described with reference to FIG. 1. The interface circuit supplies configuration data to a connected control unit and the control unit supplies control data to the light emitting diodes in accordance with this configuration data.

In the embodiment of FIG. 9, the plug 1902 includes contact pads 1911 to 1920. These are configured to engage with retractable pins when the plug is inserted into the control unit.

FIG. 20

Figure 20:
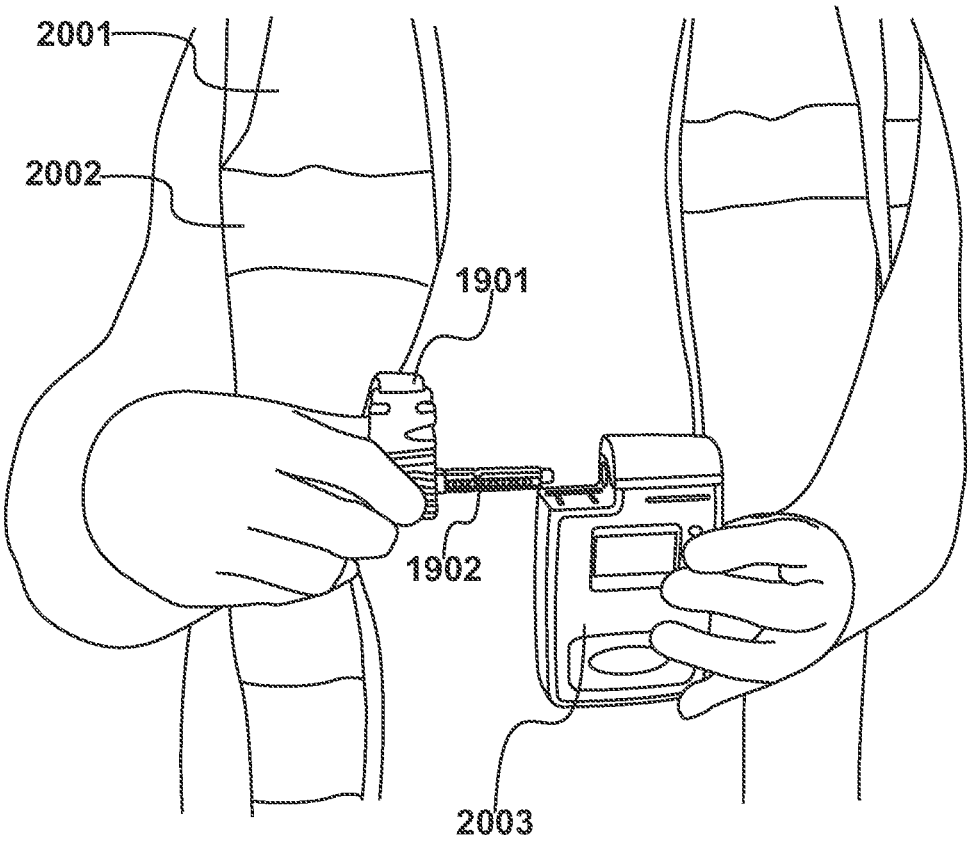
FIG. 20 shows an item of clothing for an operative working in hazardous conditions.

An item of clothing for an operative working in hazardous conditions is illustrated in FIG. 20, in the form of a jacket substantially similar to that described with reference to FIG. 14. The jacket is made substantially from a fluorescent material 2001 with light reflective strips 2002. The loom 1901 of electrical conductors connects light emitting devices to a loom plug 1902. A control unit 2003 receives the loom plug 1902.

In this embodiment, it is the loom plug 1902 that includes the data storage device 1903 and the control unit 2003 is configured to read configuration data from the data storage device 1903 to control the energization of the light emitting devices.

FIG. 21

Figure 21:
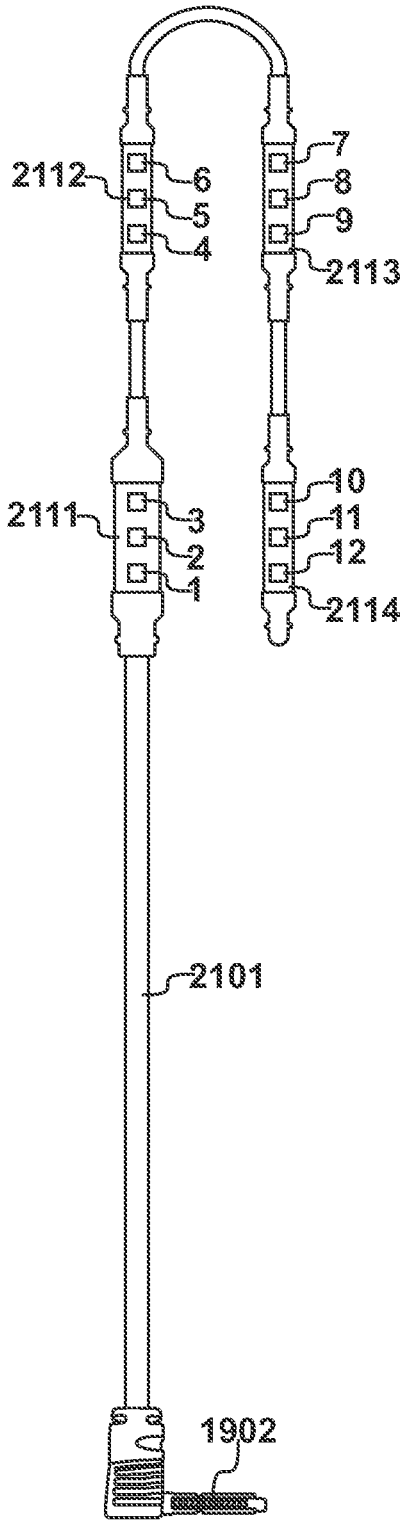
FIG. 21 shows a complete loom.

A complete loom of this embodiment is shown in FIG. 21, consisting of the control unit plug 1902, loom wires 2101, a first strip of light emitting devices 2111, a second strip of light emitting devices 2112, a third strip of light emitting devices 2113 and a fourth strip of light emitting devices 2114. These strips of light emitting devices are substantially similar to those described with reference to FIG. 4.

Each strip of light emitting devices (2111 to 2114) includes, in this embodiment, three individual light emitting devices. However, it should be appreciated that a different number of light emitting devices may be included in each strip and a different number of strips may be included on the loom. However, in this example, devices 1, 2 and 3 are included in the first strip, devices 4, 5 and 6 are included in the second strip, devices 7, 8 and 9 are included in the third strip and devices 10, 11 and 12 are included in the fourth strip.

To complete the assembly of the item of clothing, the loom illustrated in FIG. 21 is incorporated during the manufacturing of the item of clothing of the type shown in FIG. 14 and FIG. 20. Alternatively, the loom may be included in a subassembly as described with reference to FIGS. 5 to 8.

The assembly illustrated in FIG. 21 therefore facilitates a method of illuminating light emitting devices attached to an item of clothing for use in hazardous conditions. The method may be identified as comprising the steps of attaching a plurality of light emitting devices (1 to 12) to a loom 2101. The loom is terminated by a control unit plug 1902 that includes the data storage device 1903. Configuration data is written to the data storage device and the loom is located within an item of clothing. As described with reference to FIG. 20, a control unit 2003 is connected to the control unit plug 1902, wherein the control unit is configured to supply power and control data to the light emitting devices 1 to 12. Configuration data is transferred from the data storage device 1903 to the control unit 2003. In use, the operation of the light emitting devices is controlled in response to this configuration data.

FIG. 22

Figure 22:
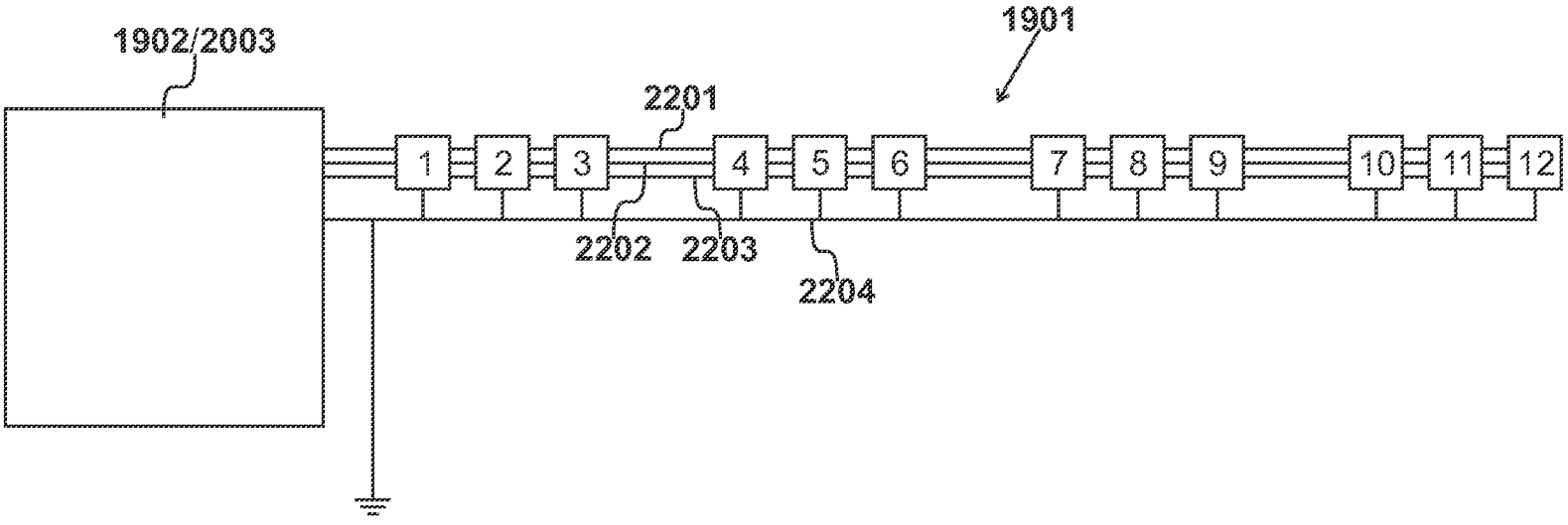
FIG. 22 shows a schematic representation of a control unit plug inserted within a control unit.

A schematic representation of a control unit plug 1902 inserted within a control unit 2003 is presented in FIG. 22.

Light emitting devices 1 to 12 are effectively connected in series but operate sequentially. First data received by a device controls the light intensity of the device and subsequent data is clocked to the next light emitting device in the series. To achieve this, the loom 1901 includes a data line 2201, a clock line 2202, a power line 2203 and a ground line 2204.

FIG. 23

Figure 23:
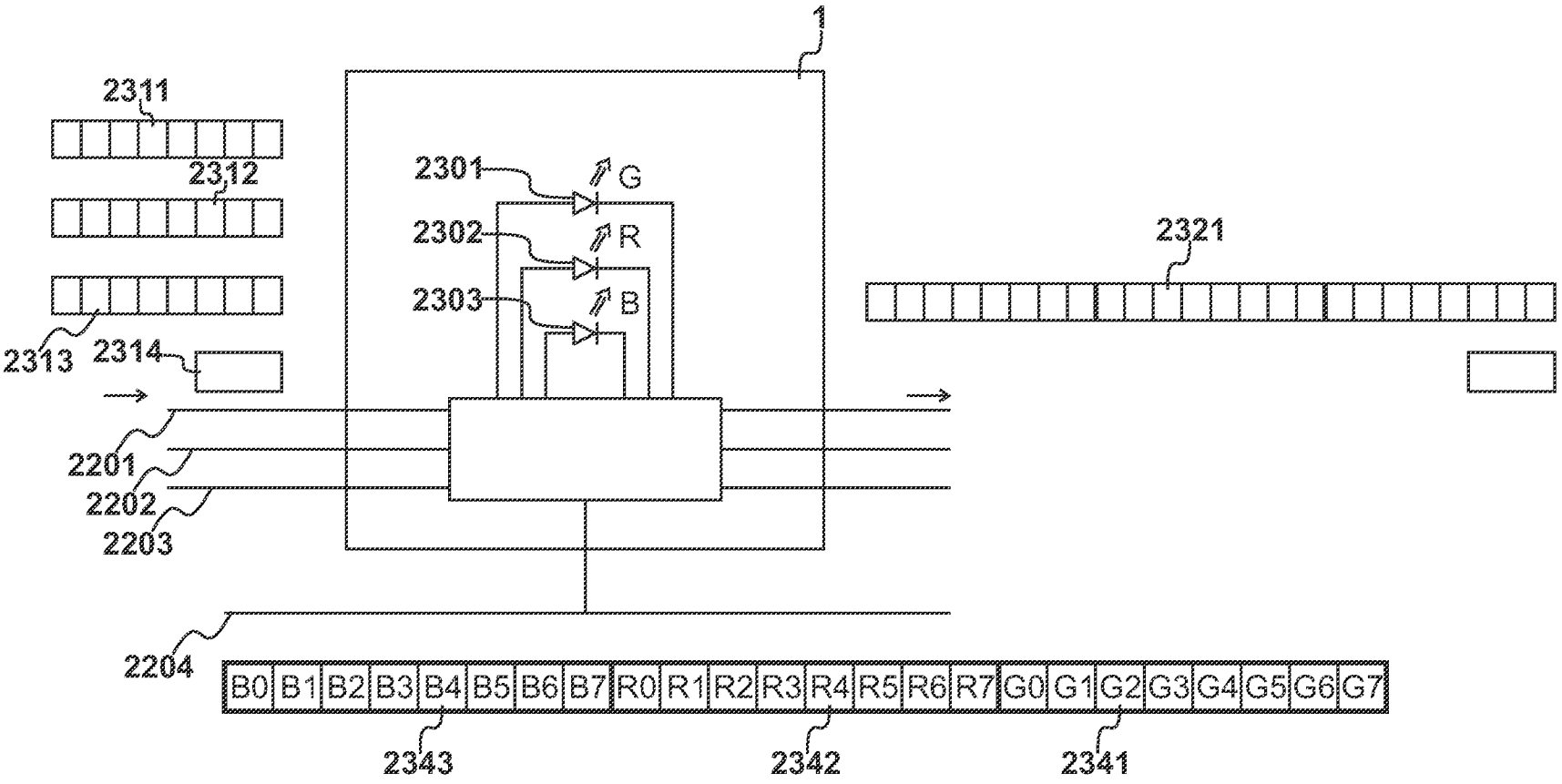
FIG. 23 shows a first light emitting device.

A first light emitting device 1 is detailed in FIG. 23. The device receives inputs on lines 2201 to 2204 and then relays these as similar outputs to the next device in the series. The configuration data specifies colors for the light emitting devices. Colored light is produced by the inclusion of a green light emitting diode 2301, a red light emitting diode 2302 and a blue light emitting diode 2303. Devices may be deployed that are primarily intended for use in video displays and as such are capable of presenting a full color gamut. However, for this particular application, faithful color reproduction is not essential and other combinations of light emitting diodes may be deployed. Furthermore, in an alternative embodiment, as an alternative to specifying data identifying the primary colors of red, green and blue, alternative configurations may convey data representing white with two other chosen colors such as red and green. In addition to specifying colors, the configuration data also specifies flashing patterns for the devices, which is achieved by periodically changing the data values.

The configuration data specifies light intensities for each of the three light emitting diodes in each of the light emitting devices. During operation, the processor 1601 reads the configuration data 1703 from memory to supply control words for the plurality of colors present at each device. Thus, in this example, device 1 receives control data in the form of a first control word 2311 for the green device 2301, a second control word 2312 for the red device 2302 and a third control word 2313 for the blue device 2303. Furthermore, the clocking of data to the next device is facilitated by the inclusion of a reset code 2314. In response to receiving a reset code, the next control data 2321 to be received is clocked on to the next device in the series.

An example of control data 2331 is also shown in FIG. 23. This consists of three control words 2341, 2342 and 2343, each, in this example, having eight bits of data. The control data is sent in the order green, red, blue with the high bits sent first.

FIG. 24

Figure 24:
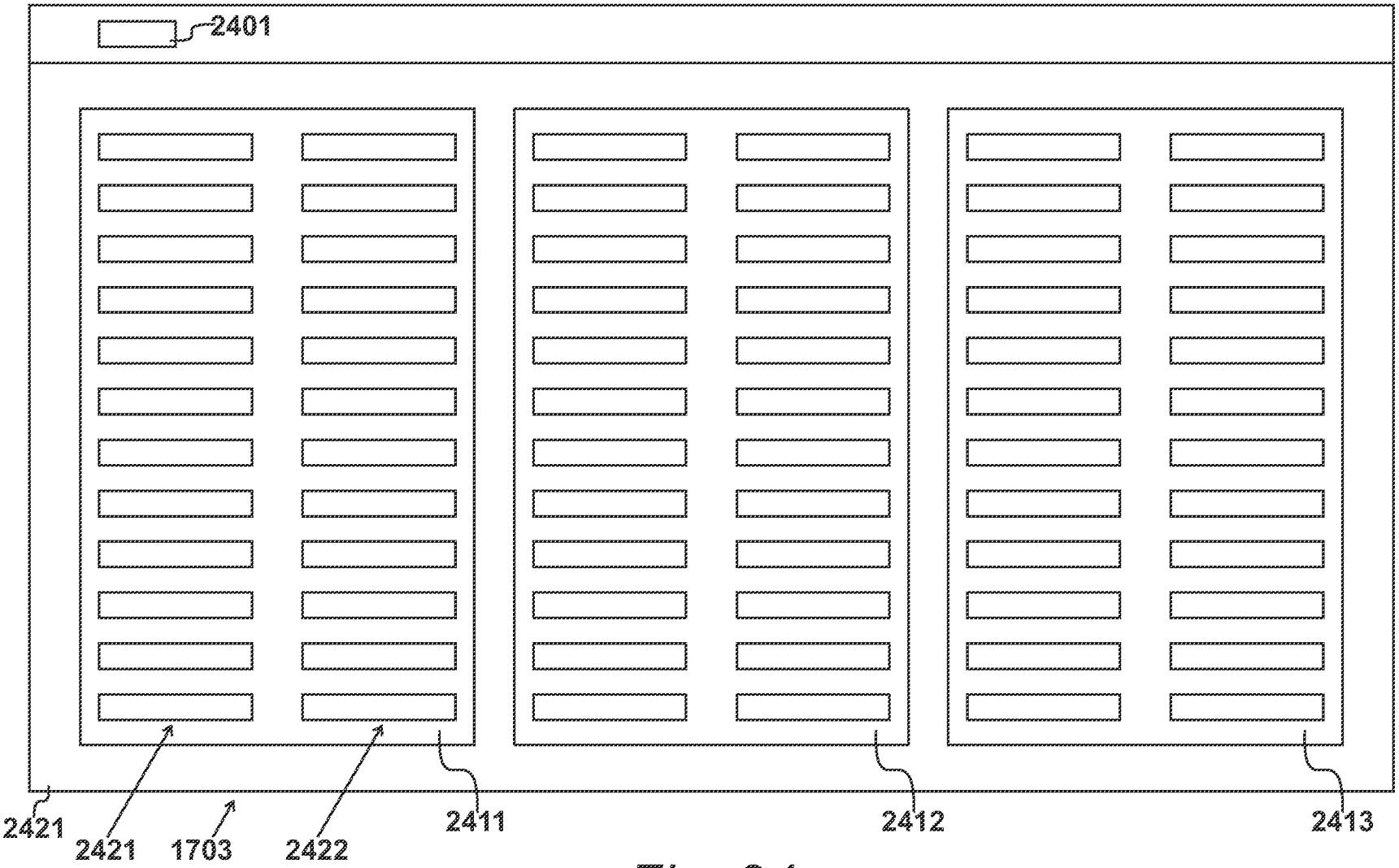
FIG. 24 shows an example of configuration data.

An example of configuration data 1703 is illustrated in FIG. 24. This configuration data is written from the data storage device 1903 to the control unit 2003. The data includes device identification data 2401 and a block of lighting control data 2402. The control unit 2003 processes the device identification data 2401 to identify the nature of the equipment to which it has been connected. Thus, in this embodiment, the data will confirm that the control unit has been connected to a loom that has a total of twelve light emitting devices. At the end of a shift, a similar engagement will be made with a charging station, after the control unit has been removed and the identification data will confirm that connection to a charging unit has been made. Thus, the control unit will then call appropriate instructions to present a compatible environment for the charging operations to be performed.

In this embodiment, the block 2402 of lighting control data includes selectable sub blocks for controlling the light emitting devices under mutually different operating conditions. In particular, the block includes a first sub block 2411, a second sub block 2412 and a third sub block 2413. The first sub block 2411 is called upon during the normal mode of operation. Similarly, the second sub block 2412 provides configuration data for the warning condition, with the third sub block 2413 providing configuration data for the alarm condition.

In this embodiment, each sub block includes two sets of control data for alternating selection, to produce light flashing. For the first sub block 2411, a first set of control data is provided in a first column 2421 and a second set of control data is provided in a second column 2422.

In an embodiment, the light emitting devices may receive new data at a periodicity of one second. During normal operation, on the first cycle, control data will be read from the first column 2421. This may activate the LEDs to illuminate white and this white illumination will persist for the full period until new data is received. On the second cycle, control data will be read from the second column 2422. In some instances, the data in the second column will be identical to the data in the first column, such that the light emitting diodes in this example will continue to be illuminated in white. Alternatively, the second column 2422 may have control data set to zero such that, during the second period, the devices do not emit light at all. On the third cycle, control data is again derived from the first column 2421, resulting in the illumination of the devices. The overall effect is that the light emitting devices will appear to flash with a period of two seconds.

In this embodiment, a similar approach is adopted when deriving control data from the second sub block 2412 and from the third sub block 2413. Thus, different colors and different flashing regimes may be selected for these particular types of display.

It is appreciated that different configurations are required in different industries. For example, red and green lights are not permitted when working on a railway and offshore use places limits on the brightness of the light emitting diodes, given that these can interfere with other equipment. Thus, it can be appreciated that the technique described with reference to FIGS. 23 and 24 provides a very adaptable platform to satisfy many different requirements, without significant reengineering of the control unit itself. The illumination of devices in different colors could also be used to identify rank or position for operatives working for emergency services.

The invention claimed is:

1. An item of clothing for an operative working in hazardous conditions, comprising:

fluorescent and light reflective material;

a loom of electrical conductors connecting light emitting devices to a loom plug, wherein said light emitting devices are connected in series; and a control unit for receiving said loom plug, wherein:

said loom plug includes a data storage device;

said control unit is configured to read configuration data from said data storage device to control energization of said light emitting devices;

first data received by each light emitting device of said light emitting devices controls illumination of that light emitting device; and subsequent data received by said light emitting device is clocked to a next light emitting device of said light emitting devices in said series.

2. The item of clothing of claim 1, wherein said light emitting devices include plural light emitting diodes for emitting mutually different colors.

3. The item of clothing of claim 2, wherein said configuration data specifies light intensities for each light emitting diode of said light emitting diodes.

4. A method of illuminating light emitting devices attached to an item of clothing for use in hazardous conditions, comprising the steps of:

attaching a plurality of light emitting devices to a loom;

terminating said loom by a control unit plug that includes a data storage device;

writing configuration data to said data storage device;

locating said loom within an item of clothing;

connecting a control unit to said control unit plug, wherein said control unit is configured to supply power and control data to said light emitting devices;

transferring said configuration data from said data storage device to said control unit; and controlling operation of said light emitting devices in response to said configuration data.

5. The method of claim 4, wherein said attaching step comprises attaching said light emitting devices in series, such that first data controls an intensity of a first light emitting device of said light emitting devices and subsequent data is clocked to a next light emitting device of said light emitting devices in said series.

6. The method of claim 5, wherein said light emitting devices include twelve light emitting devices connected in series and each light emitting device of said twelve light emitting devices comprises three light emitting diodes.

7. The method of claim 5, wherein said clocking of said subsequent data to said next light emitting device is facilitated by inclusion of reset codes in a data stream.

8. The method of claim 4, wherein said configuration data includes device identification data and a block of lighting control data.

9. The method of claim 8, wherein said block of lighting control data includes a plurality of selectable sub blocks for controlling said light emitting devices under mutually different operating conditions.

10. The method of claim 9, wherein each sub block of said sub blocks includes two sets of control data for alternating selection to produce light flashing.

11. The method of claim 10, wherein each set of control data of said two sets of control data includes respective control words for a plurality of colors.

12. The method of claim 11, wherein each control word of said control words has eight bits of data.

* * * * *